US012788080B2

(12) United States Patent
Montgomery et al.

(10) Patent No.: US 12,788,080 B2
(45) Date of Patent: Nov. 10, 2026

(54) KNIT LOWER-BODY GARMENT

(71) Applicant: NIKE, Inc., Beaverton, OR (US)

(72) Inventors: Paul R. Montgomery, Portland, OR (US); Hemantha Manjula Wijesena, Kurunegala (LK)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/540,505

(22) Filed: Dec. 14, 2023

(65) Prior Publication Data

US 2024/0108084 A1 Apr. 4, 2024

Related U.S. Application Data

(63) Continuation of application No. 17/144,656, filed on Jan. 8, 2021, now Pat. No. 11,877,605.
(Continued)

(51) Int. Cl.

| | |
|---|---|
| ***A41D 1/089*** | (2018.01) |
| ***A41B 9/00*** | (2006.01) |
| ***A41B 9/02*** | (2006.01) |
| ***A41D 27/24*** | (2006.01) |
| ***D04B 1/10*** | (2006.01) |

(Continued)

(52) U.S. Cl.

CPC ..... *A41D 1/089* (2018.01); *A41B 9/001* (2013.01); *A41B 9/004* (2013.01); *A41B 9/02* (2013.01); *A41D 27/24* (2013.01); *D04B 1/102* (2013.01); *D04B 1/24* (2013.01); *D04B 1/243* (2013.01); *D04B 7/04* (2013.01); *D04B 7/12* (2013.01); *D04B 15/362* (2013.01); *A41D 2500/10* (2013.01)

(58) Field of Classification Search

CPC ..... A41D 1/089; A41D 27/24; A41D 1/06; A41D 2300/50; A41D 2500/10; D04B 1/24; D04B 1/243; A41B 9/004; A41B 9/04; A41B 11/01; A41B 11/14

See application file for complete search history.

(56) References Cited

U.S. PATENT DOCUMENTS

| | | | |
|---|---|---|---|
| 1,629,147 | A | 5/1927 | Chatfield |
| 1,643,568 | A | 9/1927 | Redmond |

(Continued)

FOREIGN PATENT DOCUMENTS

| | | | |
|---|---|---|---|
| EP | 0811362 | A1 | 12/1997 |
| EP | 2116642 | A1 | 11/2009 |

(Continued)

OTHER PUBLICATIONS

Notice of Allowance received for Canadian Patent Application No. 3107842, mailed on May 6, 2024, 1 page.

(Continued)

*Primary Examiner* — Aiying Zhao

(74) *Attorney, Agent, or Firm* — Shook, Hardy & Bacon L.L.P.

(57) ABSTRACT

Aspects herein are directed to a knit lower-body garment, methods of manufacturing and/or forming the knit lower-body garment using a flat knitting process, and knit blanks used to form the knit lower-body garment. In example aspects, the knit lower-body garment is formed from a one-piece knit textile blank that includes partial-length knit courses in select locations to provide three-dimensional shaping to the resulting lower-body garment.

5 Claims, 10 Drawing Sheets

Related U.S. Application Data

(60) Provisional application No. 63/115,718, filed on Nov. 19, 2020.

(51) Int. Cl.

| | |
|---|---|
| ***D04B 1/24*** | (2006.01) |
| ***D04B 7/04*** | (2006.01) |
| ***D04B 7/12*** | (2006.01) |
| ***D04B 15/36*** | (2006.01) |

(56) References Cited

U.S. PATENT DOCUMENTS

| | | | | | |
|---|---|---|---|---|---|
| 2,222,946 | A | * | 11/1940 | Hall | A41D 1/14 66/189 |
| 2,406,969 | A | | 9/1946 | Silman | |
| 2,469,134 | A | * | 5/1949 | Seiler | D04B 1/126 66/189 |
| 2,522,510 | A | | 9/1950 | Maude | |
| 3,613,119 | A | | 10/1971 | Louis | |
| 3,673,820 | A | | 7/1972 | Sarmiento | |
| 3,739,398 | A | | 6/1973 | Sarmiento | |
| 3,802,229 | A | | 4/1974 | Fregeolle | |
| 3,906,754 | A | | 9/1975 | Sackman | |
| 3,938,355 | A | * | 2/1976 | Conti | D04B 1/108 66/187 |
| 3,956,909 | A | | 5/1976 | Negri | |
| RE29,034 | E | | 11/1976 | Fregeolle | |
| 4,000,630 | A | | 1/1977 | Imboden | |
| 4,040,128 | A | | 8/1977 | Imboden | |
| 4,041,736 | A | * | 8/1977 | Fregeolle | A41B 11/14 66/177 |
| 4,059,973 | A | * | 11/1977 | Gresillon | D04B 1/106 D2/712 |
| 4,205,397 | A | | 6/1980 | Bechis | |
| 4,302,853 | A | | 12/1981 | Mesek | |
| 4,412,433 | A | * | 11/1983 | Safrit | D04B 1/243 66/182 |
| 4,532,657 | A | | 8/1985 | Revene | |
| 4,689,971 | A | | 9/1987 | Conti et al. | |
| 5,081,716 | A | | 1/1992 | Lehenbauer et al. | |
| 5,202,070 | A | | 4/1993 | Schneider | |
| 5,377,507 | A | | 1/1995 | Shima | |
| 5,746,068 | A | | 5/1998 | Popa et al. | |
| 5,787,512 | A | | 8/1998 | Knox | |
| 5,823,013 | A | | 10/1998 | Lonati et al. | |
| 6,460,380 | B1 | | 10/2002 | Sciacca et al. | |
| 6,739,158 | B2 | | 5/2004 | Sciacca | |
| 6,889,530 | B2 | | 5/2005 | Urano et al. | |
| 7,017,376 | B2 | | 3/2006 | Meckley et al. | |
| 7,028,509 | B2 | | 4/2006 | Mitchell et al. | |
| 7,155,940 | B1 | | 1/2007 | Imboden et al. | |
| 7,222,504 | B2 | | 5/2007 | Nakayama | |
| 7,225,646 | B2 | | 6/2007 | Okamoto | |
| 7,363,778 | B2 | | 4/2008 | Pickering et al. | |
| 7,437,895 | B2 | | 10/2008 | Okuno | |
| 7,529,596 | B2 | | 5/2009 | Okamoto | |
| 7,536,878 | B2 | | 5/2009 | Kosui | |
| 7,577,488 | B2 | | 8/2009 | Okamoto | |
| 7,693,599 | B2 | | 4/2010 | Okamoto | |
| 7,997,102 | B2 | | 8/2011 | Obadalova | |
| 8,161,574 | B2 | * | 4/2012 | Litt | A41B 5/00 2/116 |
| 9,408,418 | B2 | | 8/2016 | Blibech | |
| 9,982,374 | B2 | | 5/2018 | Grassi et al. | |
| 10,058,131 | B2 | | 8/2018 | Solano et al. | |
| 10,221,509 | B2 | | 3/2019 | Grassi et al. | |
| 10,273,606 | B2 | | 4/2019 | Turner | |
| 10,415,164 | B2 | | 9/2019 | Diaz et al. | |
| 10,493,881 | B2 | | 12/2019 | Yao | |
| 2007/0118958 | A1 | | 5/2007 | Imboden et al. | |
| 2009/0133446 | A1 | | 5/2009 | Burrow et al. | |
| 2011/0011250 | A1 | | 1/2011 | Yang | |
| 2016/0286879 | A1 | | 10/2016 | Farmer et al. | |
| 2017/0073860 | A1 | | 3/2017 | Rockstroh et al. | |
| 2017/0290374 | A1 | | 10/2017 | Biodrowski et al. | |
| 2017/0342612 | A1 | | 11/2017 | Kawakami et al. | |
| 2019/0357613 | A1 | | 11/2019 | Aihara | |
| 2020/0170326 | A1 | | 6/2020 | Furuya | |
| 2022/0151313 | A1 | | 5/2022 | Montgomery et al. | |
| 2023/0329356 | A1 | | 10/2023 | Perry et al. | |

FOREIGN PATENT DOCUMENTS

| | | | | | |
|---|---|---|---|---|---|
| EP | 2759625 | A3 | | 5/2015 | |
| GB | 817793 | A | * | 8/1959 | D04B 1/24 |
| GB | 1371497 | A | * | 10/1974 | D04B 1/243 |
| WO | 2008/078623 | A1 | | 7/2008 | |
| WO | 2011/141006 | A2 | | 11/2011 | |
| WO | 2017/079393 | A1 | | 5/2017 | |
| WO | 2021/048215 | A1 | | 3/2021 | |

OTHER PUBLICATIONS

1710036, Stoll, Available online at: <https://patternshop.stoll.com/shop/pattern/3758/1710036?c=5>, Accessed on Jan. 30, 2018, 4 pages.

Beauty Focus [Pink] 280D IceCool Shaping Pant , iFairycon, Available online at: <https://www.ifairycon.com/beauty-focus-pink-280d-icecool-shaping-pant-280d>, Accessed on Feb. 21, 2016, 3 pages.

Chqi et al., "Three Dimensional Seamless Garment Knitting On V-Bed Flat Knitting Machines", Journal of Textile and Apparel Technology and Management, vol. 4, Issue 3, 2005, 34 pages.

Happy Butt Nº7 Single Tummy Layer, Yahaira Inc., Available online at: <https://shopyahaira.com/happy-butt-n-7-single-tummy-layer>, Accessed on Apr. 18, 2019, 3 pages.

Performance+, Stoll, Brochure, Available online at: <stoll.com>, 2016, 36 pages.

Santoni Circular Knit Women Seamless High Waist Control Short Pants, Available online at: <Alibaba.com>, Accessed on Sep. 10, 2020, 11 pages.

Shapewear, Seamless Slim Shorts with Raspberry, Lace Trim, Taitra, Available online at: <taiwantrade.com>, Accessed on Sep. 9, 2020, 5 pages.

Studio Collection Thong Panty, Victoria's Secret, Available online at: <victoriassecret.com>, Accessed on Sep. 10, 2020, 3 pages.

Wolford Sheer Touch Control Shorts, UK Lingerie, Available online at: <https://www.uklingerie.com>, Accessed on Sep. 10, 2020, 4 pages.

International Search Report and Written Opinion received for PCT Patent Application No. PCT/US2024/055537, mailed on May 8, 2025, 24 pages.

Invitation to Pay Additional Fees received for PCT Application No. PCT/US2024/055537, mailed on Feb. 13, 2025, 15 pages.

Non-Final Office Action received for U.S. Appl. No. 18/943,370, mailed on Oct. 7, 2025, 25 pages.

Final Office Action received for U.S. Appl. No. 18/943,370, mailed on Jun. 1, 2026, 35 pages.

* cited by examiner

KNIT LOWER-BODY GARMENT

CROSS-REFERENCE TO RELATED APPLICATIONS

This application, titled "Knit Lower-Body Garment," is a continuation of U.S. Non-Provisional patent application Ser. No. 17/144,656, filed Jan. 8, 2021, and titled "Knit Lower-Body Garment," which claims the benefit of priority of U.S. Application No. 63/115,718, filed Nov. 19, 2020, and titled "Knit Lower-Body Garment." The entirety of the aforementioned applications are incorporated by reference herein.

TECHNICAL FIELD

Aspects herein relate to a knit lower-body garment, a knit blank used to form the knit lower-body garment, methods of manufacturing the knit blank for the knit lower-body garment, and methods of forming the knit lower-body garment using the knit blank.

BACKGROUND

Traditional lower-body garments, including those formed from a knit textile, are generally made using a cut-and-sew construction which introduces multiple seam lines which may chafe and cause wearer discomfort. As well, traditional lower-body garments generally lack three-dimensional shaping such that the garment does not closely conform to a wearer's body which may negatively impact the aerodynamic profile of the lower-body garment, impede athletic performance, and/or cause distraction to the wearer due to excess material.

BRIEF DESCRIPTION OF THE DRAWINGS

Examples of aspects herein are described in detail below with reference to the attached drawing figures, wherein.

DETAILED DESCRIPTION

Figure 1:
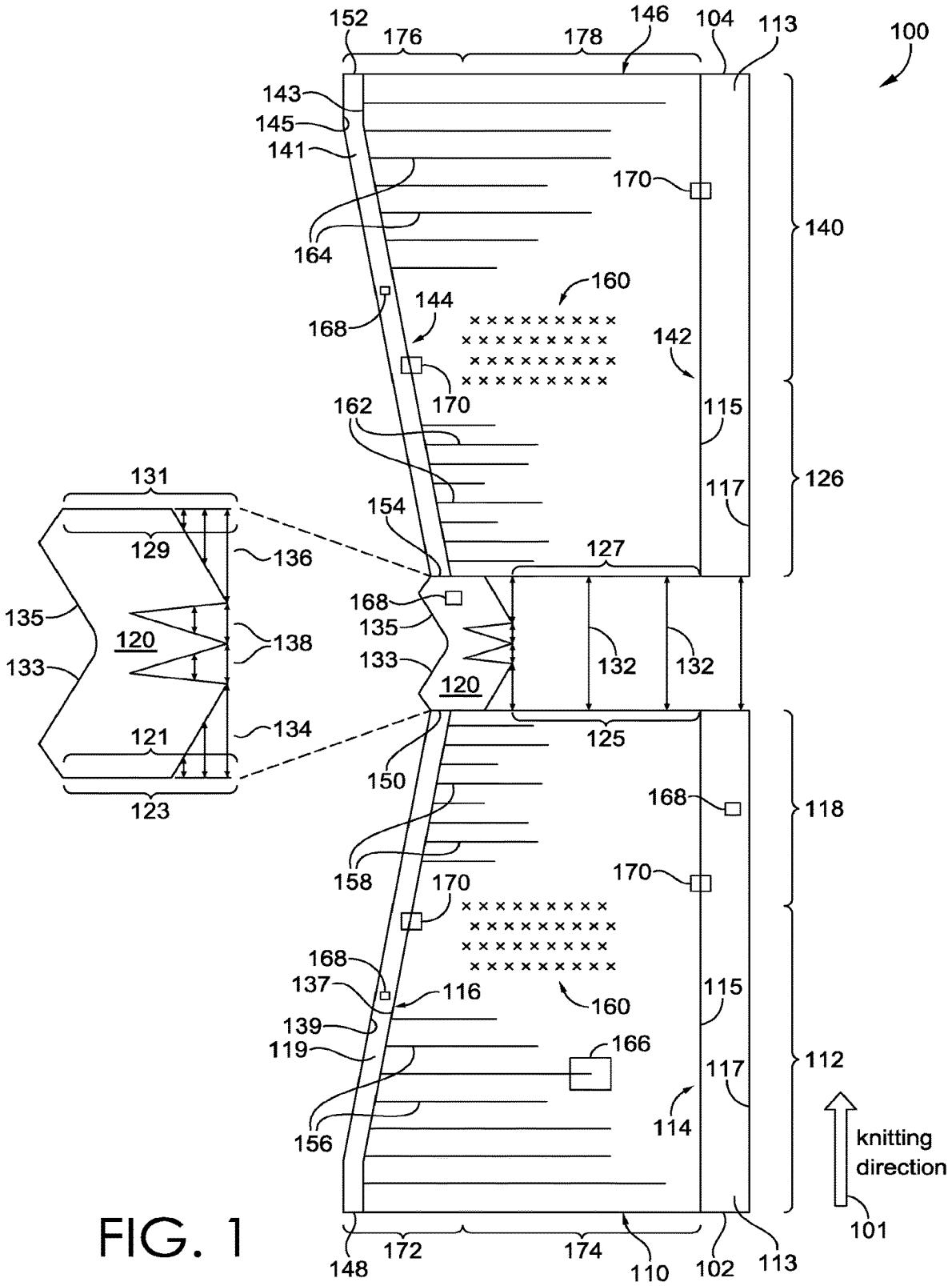
FIG. 1 illustrates an example knit blank used to form a knit lower-body garment in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional lower-body garments, including those formed from a knit textile, are generally made using a cut-and-sew construction which produces multiple seam lines. The multiple seam lines may introduce points of structural weakness as well as potentially causing wearer discomfort due to chafing. As well, traditional lower-body garments generally lack three-dimensional shaping such that the garment does not closely conform to a wearer's body, which may negatively impact the aerodynamic profile of the lower-body garment, impede athletic performance, and/or cause distraction to the wearer due to excess material.

Aspects herein relate to a knit lower-body garment, a knit blank used to form the knit lower-body garment, methods of manufacturing the knit blank for the knit lower-body garment, and methods of forming the knit lower-body garment using the knit blank. In example aspects, the knit lower-body garment is formed from a one-piece knit textile blank which reduces the number of seams needed to form the lower-body garment. In addition to forming a torso portion of the lower-body garment, the one-piece knit textile blank further forms an optional waistband and optional leg bands that surround leg opening edges of the lower-body garment. In example aspects, the lower-body garment includes a single seam having a first part that extends from a waist opening edge of a back torso portion of the lower-body garment to a first junction point. The seam then bifurcates such that a second part of the seam extends from the junction point to the first leg opening edge and a third part of the seam extends from the junction point to the second leg opening edge. Thus, the seam forms an inverted "Y" shape. Remaining portions of the lower-body garment are seamless. Minimizing the number of seams improves the structural integrity of the lower-body garment as well as reduces the chances of wearer discomfort due to chafing. Positioning the seam on the back torso portion of the garment further reduces distractions from the seam.

The ability to use a single seam to construct the lower-body garment is due to the pattern shape of the knit blank as it comes off the knit machine. As the knit blank comes off the knit machine, and in particular a flat knit machine, the knit blank extends in an x, y plane. In a knitting direction, the knit blank begins at a first back seam edge, which may be a free edge, and includes a first back torso portion that extends from the first back seam edge. A first front torso portion extends from the first back torso portion and is integrally knit with the first back torso portion. The knit blank further includes a second front torso portion, a first part of which extends from a first part of the first front torso portion and is integrally knit with the first part of the first front torso portion. A crotch gusset, in example aspects, is positioned between a second part of the first front torso portion and a second part of the second front torso portion. A first portion of the crotch gusset is integrally knit with the second part of the first front torso portion, and a second portion of the crotch gusset is integrally knit with the second part of the second front torso portion. The crotch gusset includes a first gusset back edge that is a free edge and a second gusset back edge that is also a free edge. In the knitting direction, the knit blank further includes a second back torso portion that extends from the second front torso portion and is integrally knit with the second front torso portion; the second back torso portion terminates at a second back seam edge which may be a free edge.

To form the Y-shaped seam of the lower-body garment, an upper part of the first back seam edge is affixed to an upper part of the second back seam edge, a lower part of the first back seam edge is affixed to the first gusset back edge of the crotch gusset, and a lower part of the second back seam edge is affixed to the second gusset back edge of the crotch gusset.

In example aspects, the knit lower-body garment includes knit structures and/or knit techniques that provide three-dimensional (3-D) shaping of the lower-body garment so that it closely conforms to a wearer's body thereby improving the aerodynamic profile of the garment, minimizing wearer distractions, and creating a consistent level of compression on the wearer's body. The 3-D shaping is achieved through the use of partial-length knit courses (commonly known as short rowing) in combination with full-length knit courses. The partial-length knit courses, where used, create extra volume of material. Thus, in example aspects, a first number of knit stitches may be used to create partial-length knit courses on the front torso portion of the lower-body garment, and a second number of knit stitches may be used to create partial-length knit courses on the back torso portion of the lower-body garment where the second number of knit stitches is greater than the first number of knit stitches. This results in an increased volume of material in the back torso portion to accommodate a wearer's curved gluteal region. By contrast, there is a smaller volume of material in the front torso portion because this area of the lower-body garment is configured to cover the lower front abdomen and the front of the upper thighs of a wearer which are typically flatter more planar areas of the human body.

Using knit structures and/or knit techniques to create 3-D shaping of the lower-body garment further includes reducing the number of knit courses used to form the waistband and the leg bands as compared to the torso portion of the lower-body garment to create a narrowing or reduction in circumference of these areas. This helps to provide a snug fit and prevents the waistband and/or leg bands from rolling during use. Modifying the kitting process to reduce the circumference of the waistband and the leg bands eliminates the need for post-processing steps such as adding a drawstring or elastic cord to the waistband and/or utilizing separate leg bands that are affixed to the leg portions of the lower-body garment by way of, for example, stitching or bonding.

As used herein, the term "lower-body garment" means a garment configured to cover a lower torso and/or legs of a wearer. As such, the lower-body garment may include a short, a pant, a three-quarter pant, a tight, a unitard, a skirt, and the like. In one example aspect, the lower-body garment includes a short. Positional terms used when describing the lower-body garment such as front, back, sides, upper, lower, and the like are used in relation to the lower-body garment being worn as intended by a wearer standing in an upright position. Thus, the front of the lower-body garment is configured to cover or be positioned adjacent to a front lower torso portion and/or front leg areas of the wearer, and the back of the garment is configured to cover or be positioned adjacent to a back lower torso portion (e.g., gluteal region) and/or back leg areas of the wearer. The sides of the lower-body garment are configured to cover or be positioned adjacent to the sides of the wearer's lower torso portion and/or side leg areas of the wearer. The term "upper" when used in relation to the lower-body garment means located closer to a head area of the wearer when the garment is worn, and the term "lower" means located closer to a foot area of the wearer when the garment is worn.

The term "crotch gusset" as used herein means an area of the lower-body garment configured to cover a crotch area between the wearer's legs when the lower-body garment is worn. The use of the term "gusset" means an extra volume of material created through the knitting process. The term "seam" as used herein means a structure that affixes two free edges of a textile together. The term "affixing" as used herein means joining two textile free edges together using affixing technologies known in the art such as one or more of stitching, bonding, welding, adhesives, and the like. In example aspects, the seam is created in a post-processing step after the one-piece knit textile is knit.

The term "one-piece knit textile" as used herein means a knit component formed of a unitary knit construction through a knitting process. That is, the knitting process substantially forms the various features and structures of the one-piece knit textile without the need for significant additional manufacturing steps or processes. The one-piece knit textile may include structures or elements that include one or more courses of yarn or other knit material that are joined such that the structures or elements include at least one course in common and/or share a common yarn, and/or include courses that are substantially continuous between each of the structures or elements. The term "integrally knit with" when describing different portions of the one-piece knit textile means the portions include at least one course in common and/or share a common yarn.

The term "knit blank" as used herein means the knit textile as it comes off the knit machine, where the knit blank is later used to form the lower-body garment. Aspects herein contemplate using a flat knitting process on a two-bed (V-bed) weft knit machine where the needles are arranged in a straight line to create the knit blank that forms the lower-body garment. As opposed to use of circular knit machines where the knit blank comes off the machine in a tubular form, the knit blank contemplated herein comes off of the machine in a flat form (a planar form that extends along an x, y plane). Use of a two-bed weft knit machine allows for the creation of a fully fashioned knit blank having a specified shape with one or more finished edges free from surrounding textile as the knit blank comes off the machine (a finished edge may also be known herein as a "free edge"). Having finished edges as the knit blank comes off the machine eliminates post-processing steps such as cutting pattern shapes, finishing edges, and the like.

The term "knit course" as used herein refers to a predominantly horizontal row of knit loops (in an upright textile as knit) that are produced by adjacent needles during the same knitting cycle. The knit course may comprise one or more stitch types such as a knit stitch, a held stitch, a float stitch, a tuck stitch, a transfer stitch, and the like as these terms are known in the art of knitting. The term "knit stitch" as used herein refers to the basic stitch type where the yarn is cleared from the needle after pulling a loop of the yarn from the back to the front of the textile through a previous stitch. Thus, the legs of the stitch appear on the technical face of the knit textile and the top and bottom of the stitch appear on the technical back of the textile. The term "wale" as used herein is a predominantly vertical column of intermeshed or interlooped knit loops, generally produced by the same needle at successive (but not necessarily all) courses or knitting cycles. The terms "horizontal" and "vertical" as used herein are relative to an upright textile as knit in which the heads of knit loops face toward the top of the textile and the course knit first is oriented toward the bottom of the textile.

The term "partial-length knit course" or "short row" as used herein is a term in the art that generally refers to a knit course that is turned before reaching the end of the knitting cycle (i.e., the course is not fully knitted). A "full-length knit course" refers to a knit course that is knit to the end of a knitting cycle. Partial-length knit courses introduce additional knit stitches into the knit textile beyond the knit stitches used to knit full-length knit courses. Strategically locating partial-length knit courses within areas of a knit textile adds extra volume of material to the textile and creates 3-D shaping of the knit textile. In other words, use of partial-length knit courses may introduce changes in dimension in the positive or negative z-direction to an otherwise planar knit textile.

Unless otherwise noted, all measurements provided herein are measured at standard ambient temperature and pressure (25 degrees Celsius or 298.15 K and 1 bar) with the knit blank or the lower-body garment in a resting or non-tensioned state.

FIG. 1 depicts a knit blank 100 positioned to reflect how the knit blank 100 would come off the knit machine used to knit the knit blank 100. Thus, arrow 101 reflects the knitting direction 101. The knit blank 100 is used to form the knit lower-body garment as described herein. In example aspects, the knit blank 100 is knit using elastic yarns, such as LYCRA®, that are covered with, for example, polyester and/or nylon. In example aspects, the polyester and/or nylon may be treated with a durable water repellant.

The knit blank 100 includes a first back seam edge 110. The first back seam edge 110 may, in example aspects, comprise a finished edge free from surrounding textile. In other aspects, the first back seam edge 110 may be a knit structure that demarcates a separation line from an integrally knit second knit blank. In other words, it is contemplated herein that the knit blank 100 may be singly knitted or may be knit as a run of blanks and then later separated or cut from the run of blanks. In at least some aspects, the first back seam edge 110 comprises a full-length knit course extending along the length of the first back seam edge 110.

A first back torso portion 112 extend from the first back seam edge 110. In example aspects, the first back torso portion 112 of the knit blank 100 forms a left gluteal region of the resulting lower-body garment. The first back torso portion 112 includes a first edge 114 and a second edge 116. When formed into the lower-body garment, the first edge 114 may be known as the upper edge 114, and the second edge 116 may be known as the lower edge 116. The first edge 114 and the second edge 116 demarcate the right and left boundaries of the first back torso portion 112 of the knit blank 100. In example aspects, the first edge 114 and the second edge 116 may comprise finished edges free from surround textile. Alternatively, the first edge 114 and the second 116 may not constitute finished edges free from surrounding textile. In example aspects, knit courses used to knit the first back torso portion 112 are oriented generally perpendicular to the first edge 114 and the second edge 116.

A first front torso portion 118 extends from and is integrally knit with the first back torso portion 112. The first front torso portion 118 forms a left front region of the resulting lower-body garment. The first front torso portion 118 includes the first edge 114 and the second edge 116. In example aspects, knit courses used to knit the first front torso portion 118 are oriented generally perpendicular to the first edge 114 and the second edge 116.

The transition from the first back torso portion 112 to the first front torso portion 118 may be a gradual transition without a visual demarcation in some example aspects. In other example aspects, there may be a visual demarcation between the first back torso portion 112 and the first front torso portion 118. For example, a different knit structure 160 (shown schematically as an "x") may be used to visually demarcate the transition of the first back torso portion 112 to the first front torso portion 118. In one example aspect, the knit structure 160 may include from about 15 to about 100 courses of an ottoman stitch although other stitch types are contemplated herein. When the knit blank 100 is formed into the lower-body garment, the different knit structure 160 may be positioned over the left side area of the wearer.

The knit blank 100 further includes a crotch gusset 120. With respect to FIG. 1 and the magnified view shown, a first portion 121 of the crotch gusset 120 extends from and is integrally knit with a second part 123 of the first front torso portion 118. In one example aspect, the crotch gusset 120 is knit in a reciprocating motion with a first subset of active needles that are a subset of the set of needles used to knit the first front torso portion 118. In other example aspects, the crotch gusset 120 may be knit with a separate set of needles (a separate feeder(s)) than the needles used to knit the first front torso portion 118. Regardless, while the crotch gusset 120 is being knit, the inactive needles hold the last course of loops from a first part 125 of the first front torso portion 118. Once the crotch gusset 120 is knit, the inactive needles that are holding the last course of loops from the first part 125 of the first front torso portion 118 begin knitting to form the second front torso portion 126; this is graphically represented by arrows 132. Thus, a first part 127 of the second front torso portion 126 extends from and is integrally knit with the first part 125 of the first front torso portion 118. A second part 131 of the second front torso portion 126 extends from and is integrally knit with a second portion 129 of the crotch gusset 120 such that the crotch gusset 120 is positioned between the second part 123 of the first front torso portion 118 and the second part 131 of the second front torso portion 126.

With respect to the crotch gusset 120, and as best shown in the magnified view, the crotch gusset 120 is knit with a number of widening reciprocated sections and narrowing reciprocated sections using a set of needles such that some needles of the set of needles are active when knitting particular sections of the crotch gusset and other needles of the set of needles are inactive. The arrows shown in the magnified view represent areas where inactive needles hold the last course of loops from the previously knit sections while other sections of the crotch gusset 120 are knit in the knitting direction 101. Once a particular section is knit, the inactive needles begin knitting to join together the different knit sections. For instance, arrows 134 graphically represent where the first portion 121 of the crotch gusset 120 is integrally knit with the second part 123 of the first front torso portion 118. Arrows 136 graphically represent where the second portion 129 of the crotch gusset 120 is integrally knit with the second part 131 of the second front torso portion 126. Arrows 138 graphically represent where different reciprocally knit sections of the crotch gusset are integrally knit together. The crotch gusset 120 includes a first gusset back edge 133 that is a finished edge free from surrounding textile and a second gusset back edge 135 that is a finished edge free from surrounding textile. The shape shown for the crotch gusset 120 is illustrative only, and it is contemplated herein that the crotch gusset 120 may have different shapes than shown.

The second front torso portion 126 is integrally knit with and extends from both the first front torso portion 118 and the crotch gusset 120. The second front torso portion 126 forms, in example aspects, a right front region of the resulting lower-body garment. The second front torso portion 126 includes a first edge 142. In example aspects, the first edge 142 may comprise a continuous extension of the first edge 114 of the first front torso portion 118 and the first back torso portion 112. The second front torso portion 126 further includes a second edge 144. In example aspects, the second edge 144 may be separated from the second edge 116 of the first front torso portion 118 and the first back torso portion 112 by the crotch gusset 120. Thus, in example aspects, the second edge 144 may not comprise a continuous extension of the second edge 116. When formed into the lower-body garment, the first edge 142 may be known as the upper edge 142, and the second edge 144 may be known as the lower edge 144. The first edge 142 and the second edge 144 demarcate the right and left boundaries of the second front torso portion 126 of the knit blank 100. In example aspects, the first edge 142 and the second edge 144 may comprise finished edges free from surrounding textile. Alternatively, the first edge 142 and the second edge 144 may not constitute finished edges free from surrounding textile. The knit courses used to knit the second front torso portion 126 are oriented generally perpendicular to the first edge 142 and the second edge 144.

A second back torso portion 140 extends from and is integrally knit with the second front torso portion 126. In example aspects, the second back torso portion 140 forms a right gluteal region of the resulting lower-body garment. The second back torso portion 140 includes the first edge 142 and the second edge 144. The second back torso portion 140 terminates at a second back seam edge 146. The second back seam edge 146 may, in example aspects, comprise a finished edge free from surrounding textile. In other aspects, the second back seam edge 146 may be a knit structure that demarcates a separation line from an integrally knit additional knit blank. As mentioned, it is contemplated herein that the knit blank 100 may be singly knitted or may be knit as a run of blanks and then later separated or cut from the run of blanks. In at least some aspects, the second back seam edge 146 comprises a full-length knit course extending along the length of the second back seam edge 146.

The transition from the second front torso portion 126 to the second back torso portion 140 may be a gradual transition without a visual demarcation in some example aspects. In other example aspects, there may be a visual demarcation between the second front torso portion 126 and the second back torso portion 140 similar to that described for the first back torso portion 112 and the first front torso portion 118. For example, the knit structure 160 (shown schematically as an "x") may be used to visually demarcate the transition of the second front torso portion 126 to the second back torso portion 140. In one example aspect, the knit structure 160 may include from about 15 to about 100 courses of an ottoman stitch although other stitch types are contemplated herein. When the knit blank 100 is formed into the lower-body garment, the knit structure 160 may be positioned over the right side area of the wearer.

The knit blank 100 further includes an optional waistband 113, an optional first leg band 119, and an optional second leg band 141. Once the knit blank 100 is fully knitted, the waistband 113 extends continuously from a first waistband seam edge 102 to a second waistband seam edge 104. In example aspects, the first waistband seam edge 102 linearly extends from the first back seam edge 110, and the second waistband seam edge 104 linearly extends from the second back seam edge 146. The waistband 113 includes a first edge 115 and an opposite second edge 117. When the knit blank 100 is formed into a lower-body garment, the first edge 115 may be referred to as a lower waistband edge 115, and the second edge 117 may be referred to as an upper waistband edge 117. In example aspects, the first edge 115 extends from and is integrally knit with the first edge 114 of the first back torso portion 112 and the first front torso portion 118 and the first edge 142 of the second front torso portion 126 and the second back torso portion 140. In example aspects, the second edge 117 of the waistband 113 comprises a finished edge free from surrounding textile.

The first leg band 119 includes a first end 148 that terminates at the first back seam edge 110, and a second end 150 that is integrally knit with the first portion 121 of the crotch gusset 120. In example aspects, the first end 148 linearly extends from the first back seam edge 110. The first leg band 119 further includes a first edge 137 and an opposite second edge 139. When the knit blank 100 is formed into the lower-body garment, the first edge 137 may be referred to as an upper leg band edge 137, and the second edge 139 may be referred to as a lower leg band edge 139. In example aspects, the first edge 137 of the first leg band 119 extends from and is integrally knit with the second edge 116 of the first back torso portion 112 and the first front torso portion 118. In example aspects, the second edge 139 of the first leg band 119 comprises a finished edge free from surrounding textile.

The second leg band 141 includes a first end 152 that terminates at the second back seam edge 146 and a second end 154 that is integrally knit with the second portion 129 of the crotch gusset 120. In example aspects, the first end 152 linearly extends from the second back seam edge 146. The second leg band 141 further includes a first edge 143 and an opposite second edge 145. When the knit blank 100 is formed into the lower-body garment, the first edge 143 may be referred to as an upper leg band edge 143, and the second edge 145 may be referred to as a lower leg band edge 145. In example aspects, the first edge 143 of the second leg band 141 extends from and is integrally knit with the second edge 144 of the second front torso portion 126 and the second back torso portion 140. In example aspects, the second edge 145 of the second leg band 141 comprises a finished edge free from surrounding textile.

In example aspects, one or more separate sets of needles may be used to knit the waistband 113, the first leg band 119, and the second leg band 141. In this aspect, the waistband 113, the first leg band 119, and the second leg band 141 may be joined to the edges 114, 142, 116, and 144 through, for instance, linking stitches. For example, the first edge 115 of the waistband 113 may be joined to the edges 114 and 142 through linking stitches, the first edge 137 of the first leg band 119 may be joined to the second edge 116 through linking stitches, and the first edge 143 of the second leg band 141 may be joined to the second edge 144 through linking stitches. In one aspect, at least one of the sets of needles used to knit the waistband 113 may also be used to knit the first leg band 119 and the second leg band 141.

In example aspects, and as explained further below, the first back torso portion 112, the first front torso portion 118, the second front torso portion 126, and the second back torso portion 140 may be a single jersey knit structure (i.e., a knit structure that is knit on, for example, the front bed of a V-bed weft knit machine). In example aspects, the crotch gusset 120, the waistband 113, the first leg band 119, and the second leg band 141 may be a double jersey knit structure (i.e., a knit structure that is knit on both the front bed and the back bed of a V-bed weft knit machine). The extra volume of material imparted by a double knit structure may be useful to provide structure to the waistband 113, the first leg band 119, and the second leg band 141 to prevent these portions from rolling over during wear. Additionally, having an extra volume of material in the crotch gusset 120 may be useful for moisture absorption.

In example aspects, a distance between the second edge 117 of the waistband 113 and the second edge 139 of the first leg band 119 at the first front torso portion 118 is less than a distance between the second edge 117 of the waistband 113 and the second edge 139 of the first leg band 119 at the first back torso portion 112. Similarly, a distance between the second edge 117 of the waistband 113 and the second edge 145 of the second leg band 141 at the second front torso portion 126 is less than a distance between the second edge 117 of the waistband 113 and the second edge 145 of the second leg band 141 at the second back torso portion 140. Stated differently, a full-length knit course used to knit the first back torso portion 112 and the second back torso portion 140 may include a greater number of knit stitches than a full-length knit course used to knit the first front torso portion 118 and the second front torso portion 126. As used with respect to the knit blank 100, a full-length knit course is a knit course that extends between the edges 114 and 116 and the edges 142 and 144.

The narrower width of the first front torso portion 118 and the second front torso portion 126 may be achieved by using a knit stitch transfer process when forming the second edges 116 and 144. More specifically, a narrowing knit stitch transfer process may be used along the second edge 116 to transfer a knit stitch inwardly from one needle to another so that the width of the knit blank 100 is narrowed as the knit blank 100 is knit in the knitting direction 101 from the first back torso portion 112 to the first front torso portion 118. Conversely, a widening knit stitch transfer process may be used along the second edge 144 to transfer a knit stitch outwardly from one needle to another so that the width of the knit blank 100 widens as the knit blank 100 is knit in the knitting direction 101 from the second front torso portion 126 to the second back torso portion 140. In example aspects, a knit stitch transfer process is not used when knitting the first edges 114 and 142 such that wale positioned within, for example, five knit stitches of the first edges 114 and 142 would extend from the first back seam edge 110 to the second back seam edge 146. Having a narrower width for the first front torso portion 118 and the second front torso portion 126 helps to reduce the volume of material in these areas. Having a wider width for the first back torso portion 112 and the second back torso portion 140 creates an extra volume of material in these areas which helps to accommodate a wearer's curved gluteal region.

When the knit blank 100 is formed into the lower-body garment, different edges of the knit blank 100 are affixed together using, for example, stitching or bonding. In example aspects, the first waistband seam edge 102 is affixed to the second waistband seam edge 104. A first part 174 of the first back seam edge 110 is affixed to a first part 178 of the second back seam edge 146. The first part 174 of the first back seam edge 110 extends from the first edge 114 to a location offset inwardly from the second edge 116. In example aspects, the amount of offset may be from about 1 cm to about 15 cm. The first part 178 of the second back seam edge 146 extends from the first edge 142 to a location offset inwardly from the second edge 144. In example aspects, the amount of offset may be from about 1 cm to about 15 cm or equal to the amount of offset of the first part 174 of the first back seam edge 110. When the knit blank 100 is formed into the lower-body garment, the first part 174 of the first back seam edge 110 and the first part 178 of the second back seam edge 146 may be known respectively as the upper part 174 of the first back seam edge 110 and the upper part 178 of the second back seam edge 146.

A second part 172 of the first back seam edge 110 is affixed to the first gusset back edge 133, and a second part 176 of the second back seam edge 146 is affixed to the second gusset back edge 135. The second part 172 of the first back seam edge 110 extends from the termination of the first part 174 of the first back seam edge 110 to the second edge 139 of the first leg band 119, and the second part 176 of the second back seam edge 146 extends from the termination of the first part 178 of the second back seam edge 146 to the second edge 145 of the second leg band 141. When the knit blank 100 is formed into the lower-body garment, the second part 172 of the first back seam edge 110 and the second part 176 of the second back seam edge 146 may be known respectively as the lower part 172 of the first back seam edge 110 and the lower part 176 of the second back seam edge 146.

As mentioned, partial-length knit courses may be used create extra volume of material in select areas of the knit blank 100. Partial-length knit courses are schematically illustrated in FIG. 1 as horizontally extending lines extending from the second edges 116 and 144. Additionally, or alternatively, partial-length knit courses may extend from the first edges 114 and 142. Thus, the first back torso portion 112 includes partial-length knit courses 156, the first front torso portion 118 includes partial-length knit courses 158, the second front torso portion 126 includes partial-length knit courses 162, and the second back torso portion 140 includes partial length knit courses 164. In example aspects, a first number of knit stitches may be used to create the partial-length knit courses 158 and 162 on the first front torso portion 118 and the second front torso portion 126 respectively. A second number of knit stitches may be used to create the partial-length knit courses 156 and 164 on the first back torso portion 112 and the second back torso portion 140 respectively. In example aspects, the second number of knit stitches is greater than the first number of knit stitches. This results in an increased volume of material in the first back torso portion 112 and the second back torso portion 140 to accommodate a wearer's curved gluteal region. Conversely, using a smaller number of knit stitches to form the partial-length knit courses 158 and 162 on the first front torso portion 118 and the second front torso portion 126 reduces the volume of knit material in these areas to accommodate a wearer's lower front abdomen and the front of the upper thighs of the wearer which are typically flatter more planar areas of the human body. The depiction of the partial-length knit courses 156, 158, 162, and 164 (e.g., location, number, and comparative length) is illustrative and it is contemplated herein that other configurations may be used.

Figure 2:
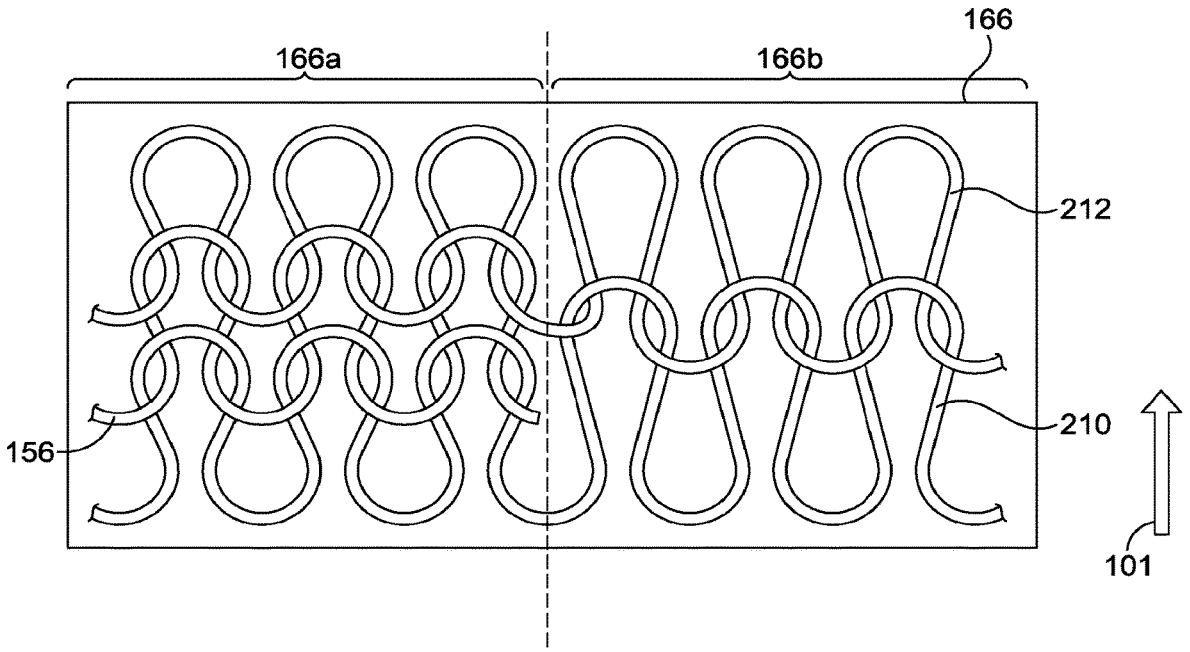
FIG. 2 illustrates an example knit schematic taken at the area indicated in FIG. 1 in accordance with aspects herein.

Reference numeral 166 indicates an area that includes a partial-length knit course 156 and full-length knit courses, and a magnified view of the area 166 is depicted in FIG. 2. In the knitting direction 101, the area 166 includes a first full-length knit course 210, the partial-length knit course 156, and a second full-length knit course 212. The full-length knit courses 210 and 212, in example aspects, extend between the first edge 114 and the second edge 116 of the first back torso portion 112 and comprise, in example aspects, knit stitches. The partial-length knit course 156 is depicted as terminating such that the partial-length knit course 156 does not extend to the first edge 114. The partial-length knit course 156 may also be formed using knit stitches. More particularly, in sub-area 166*a*, the full-length knit course 210 is interlooped with the partial-length knit course 156, and the partial-length knit course 156 is further interlooped with the full-length knit course 212 such that the partial-length knit course 156 is positioned between the full-length knit courses 210 and 212. In the sub-area 166*a*, there are approximately 9 knit stitches. In sub-area 166*b*, which has about the same surface area as the sub-area 166*a*, the full-length knit course 210 is interlooped directly with the full-length knit course 212. In the sub-area 166*b*, there are approximately 6 knit stitches. As seen, using partial-length knit courses, such as the partial-length knit course 156, adds extra volume of material through extra knit stitches.

Figure 3:
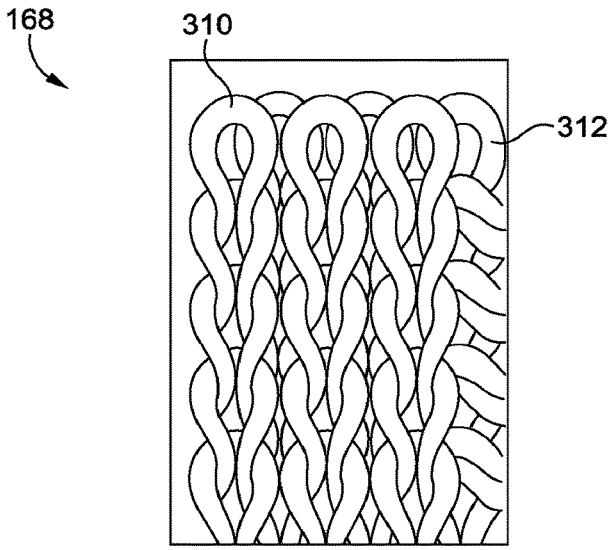
FIG. 3 illustrates an example knit schematic taken at the areas indicated in FIG. 1 in accordance with aspects herein.
Figure 4:
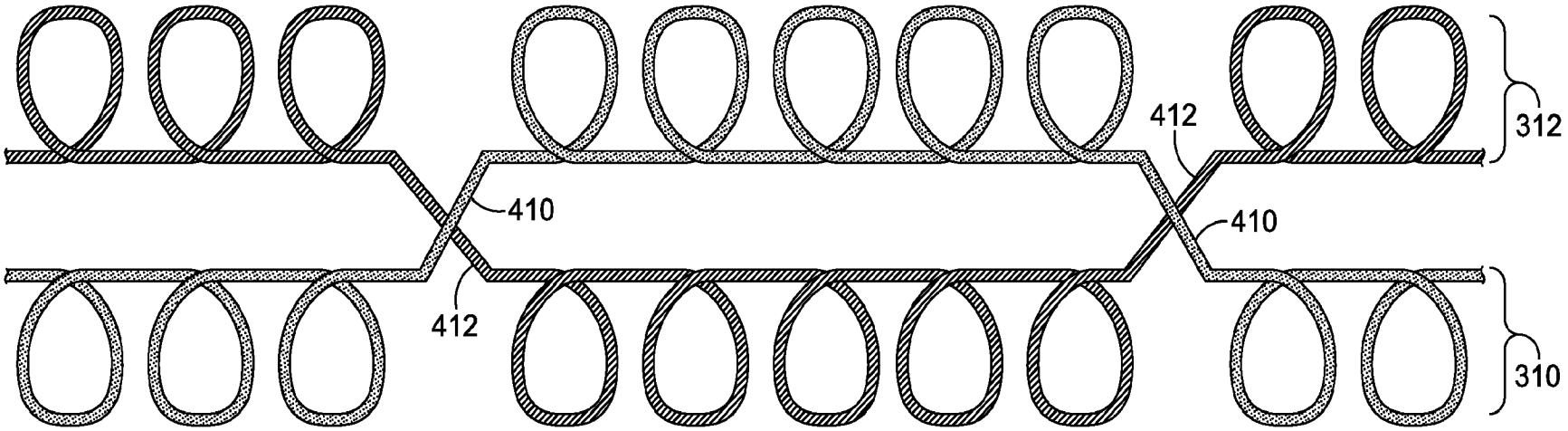
FIG. 4 illustrates an example knit schematic used to knit, for example, a waistband of the knit lower-body garment in accordance with aspects herein.

FIG. 3 depicts a magnified view of areas 168 indicated in FIG. 1, where the areas 168 are located at the waistband 113, the first leg band 119, the second leg band 141, and the crotch gusset 120. The area 168 includes a double knit structure that has courses of interlooped front knit stitches 310 and courses of interlooped back knit stitches 312. In example aspects, the front knit stitches 310 may not be interlooped with the back knit stitches 312 (i.e., the front layer remains separate from the back layer). In other example aspects, and as shown in FIG. 4, one or more yarns, such as yarn 410, used to form the front knit stitches 310 may be transferred to the back and interlooped with the back knit stitches 312 before transferring again to the front. Similarly, one or more yarns, such as yarn 412, used to form the back knit stitches 312, may be transferred to the front and interlooped with the front knit stitches 310 before transferring again to the back. In example aspects, the knit structure shown in FIG. 4 may be used in the waistband 113. Any and all aspects, and any variation thereof, are contemplated as being within aspects herein. As mentioned above, using a double knit structure in the waistband 113, the first leg band 119, and the second leg band 141 may provide support to these areas and prevent the waistband 113, the first leg band 119, and the second leg band 141 from rolling over during use. Using a double knit structure in the crotch gusset 120 may provide an extra layer of material for moisture absorption.

Figure 5:
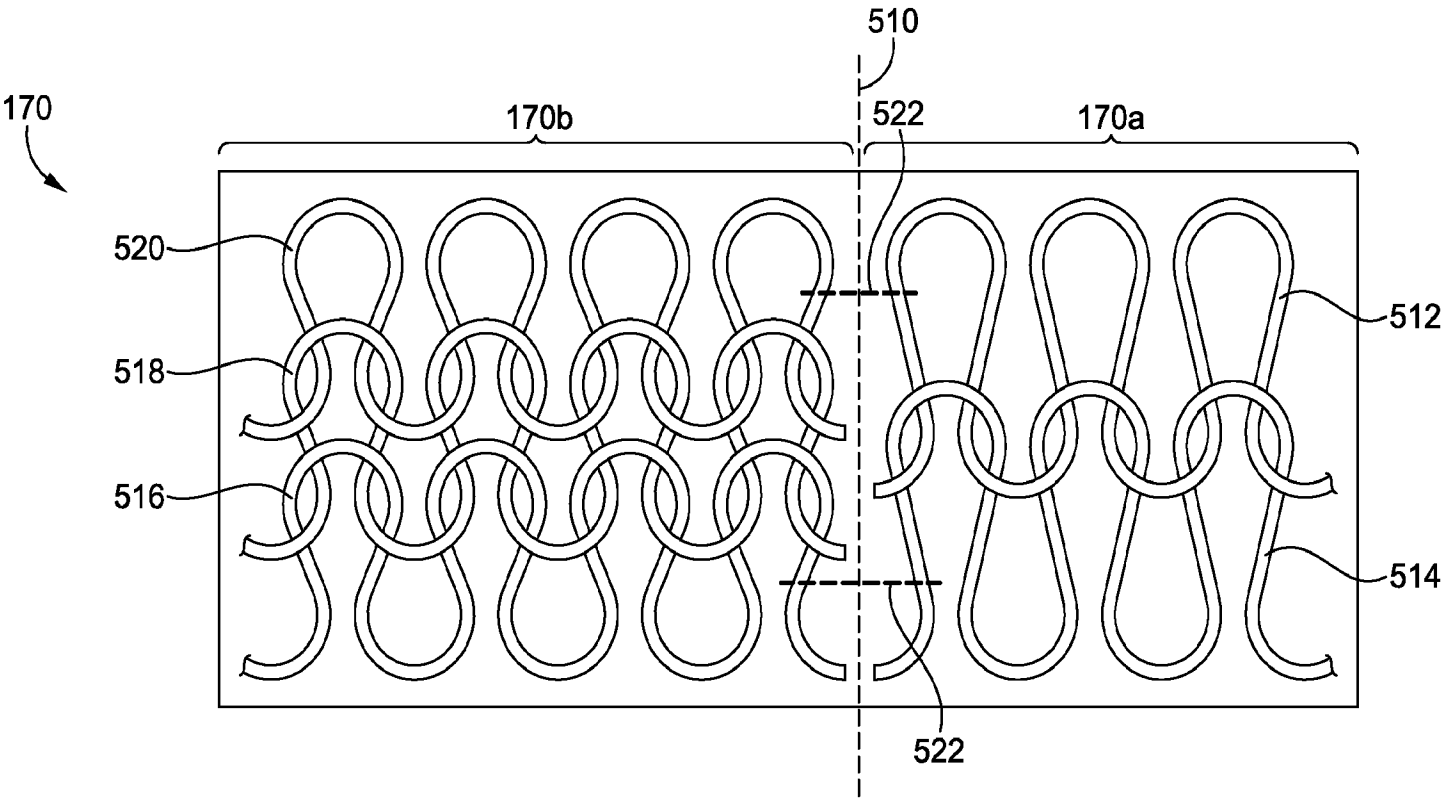
FIG. 5 illustrates an example knit schematic taken at the areas indicated in FIG. 1 in accordance with aspects herein.

FIG. 5 depicts a magnified view of the areas 170 depicted in FIG. 1. The areas 170 are located at the junction of the waistband 113 with the first back torso portion 112, the first front torso portion 118, the second front torso portion 126, and the second back torso portion 140; the junction of the first leg band 119 with the first back torso portion 112 and the first front torso portion 118; and the junction of the second leg band 141 with the second front torso portion 126 and the second back torso portion 140. As shown in FIG. 5, the area 170 includes sub-area 170*a* and sub-area 170*b*. Sub-area 170*a* represents a portion of the knit structure of the waistband 113, the first leg band 119, and the second leg band 141, and sub-area 170*b* represents a portion of the knit structure of, for instance, the first back torso portion 112, the first front torso portion 118, the second front torso portion 126, and/or the second back torso portion 140. The line 510 indicates the junction area between the two knit structures.

In example aspects, the waistband 113, the first leg band 119, and the second leg band 141 may be knit with a fewer number of knit courses than the full-length knit courses and the partial-length knit courses used to knit the first back torso portion 112, the first front torso portion 118, the second front torso portion 126, and the second back torso portion 140. For instance, the sub-area 170*a* includes knit course 512 and knit course 514. In example aspects, the knit courses 512 and 514 extend respectively between the first edge 115 and the second edge 117 of the waistband, between the first edge 137 and the second edge 139 of the first leg band 119, and between the first edge 143 and the second edge 145 of the second leg band 141. The sub-area 170*b* includes knit course 516, knit course 518, and knit course 520 such that the sub-area 170*b* includes a greater number of knit courses than the sub-area 170*a* Linking stitches 522 may be used to link the knit courses 512 and 514 with the knit courses 516, 518, and 520. The use of a fewer number of knit courses to knit the waistband 113, the first leg band 119, and the second leg band 141 compared to the number of knit courses used to knit the first back torso portion 112, the first front torso portion 118, the second front torso portion 126, and the second back torso portion 140 helps to reduce the circumference of the waistband 113, the first leg band 119, and the second leg band 141. This, in turn, may provide a snugger fit at the waist area and leg area of a wearer when the knit blank 100 is formed into the lower-body garment. A snugger fit may improve the aerodynamic profile of the lower-body garment, prevent shifting of the lower-body garment during wear, and reduce the chances of the waistband 113, the first leg band 119, and the second leg band 141 from rolling over during use.

FIGS. 6-9 respectively depict a front view, a back view, a right-side view, and a bottom view of a lower-body garment 600 formed from the knit blank 100. The lower-body garment 600 is shown in the form of a short but it is contemplated herein that the lower-body garment may assume other forms such as a tight, a pant, a three-quarter tight, a unitard, a singlet, a capri, and the like. Regarding FIGS. 6 and 7, a hypothetical midline 610 is shown that divides the lower-body garment 600 into right and left halves that have generally the same surface area. Regarding FIG. 8, a hypothetical mid-axillary line 810 is shown that divides the lower-body garment 600 into a front half 812 and a back half 814.

Figure 6:
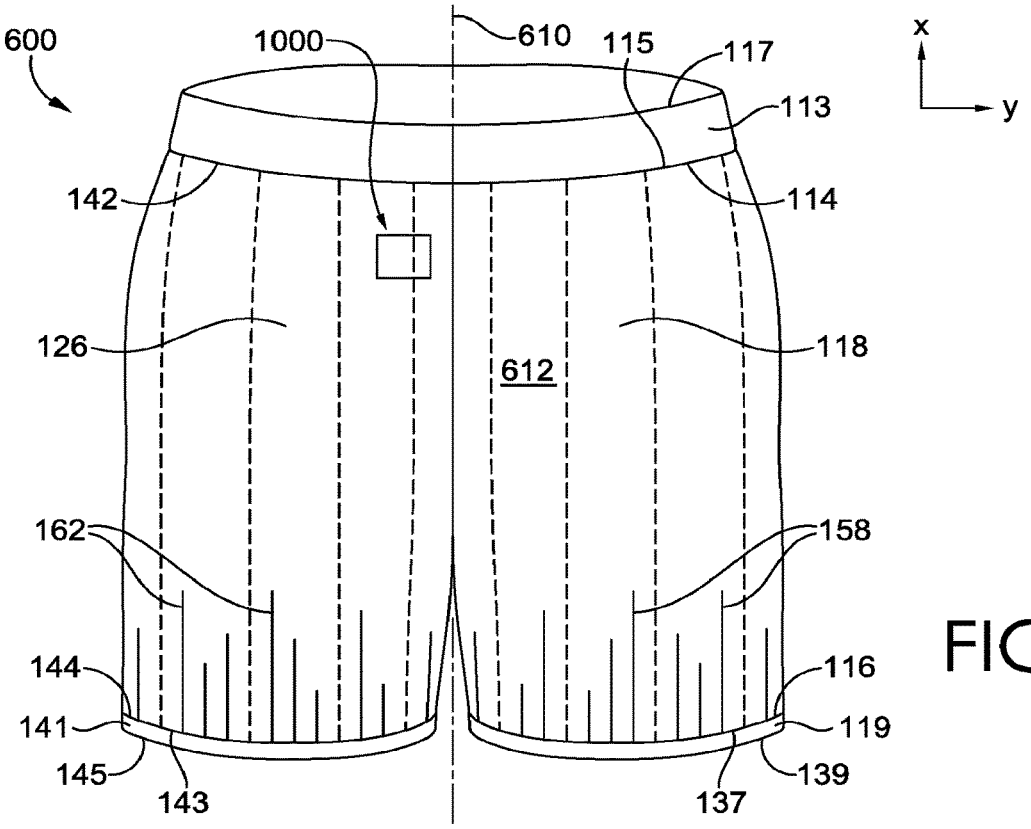
FIG. 6 illustrates a front view of the knit lower-body garment formed from the knit blank of FIG. 1 in accordance with aspects herein.

With respect to FIG. 6, the lower-body garment 600 includes a front torso portion 612 formed from the first front torso portion 118 and the second front torso portion 126. The waistband 113 extends from the front torso portion 612, and the upper waistband edge 117 forms a continuous waist opening edge of the lower-body garment 600. The first leg band 119 extends from the first front torso portion 118, and the lower leg band edge 139 forms a continuous first leg opening edge of the lower-body garment 600. The second leg band 141 extends from the second front torso portion 126, and the lower leg band edge 145 forms a continuous second leg opening edge of the lower-body garment 600. In example aspects, the front torso portion 612 is seamless.

Figure 7:
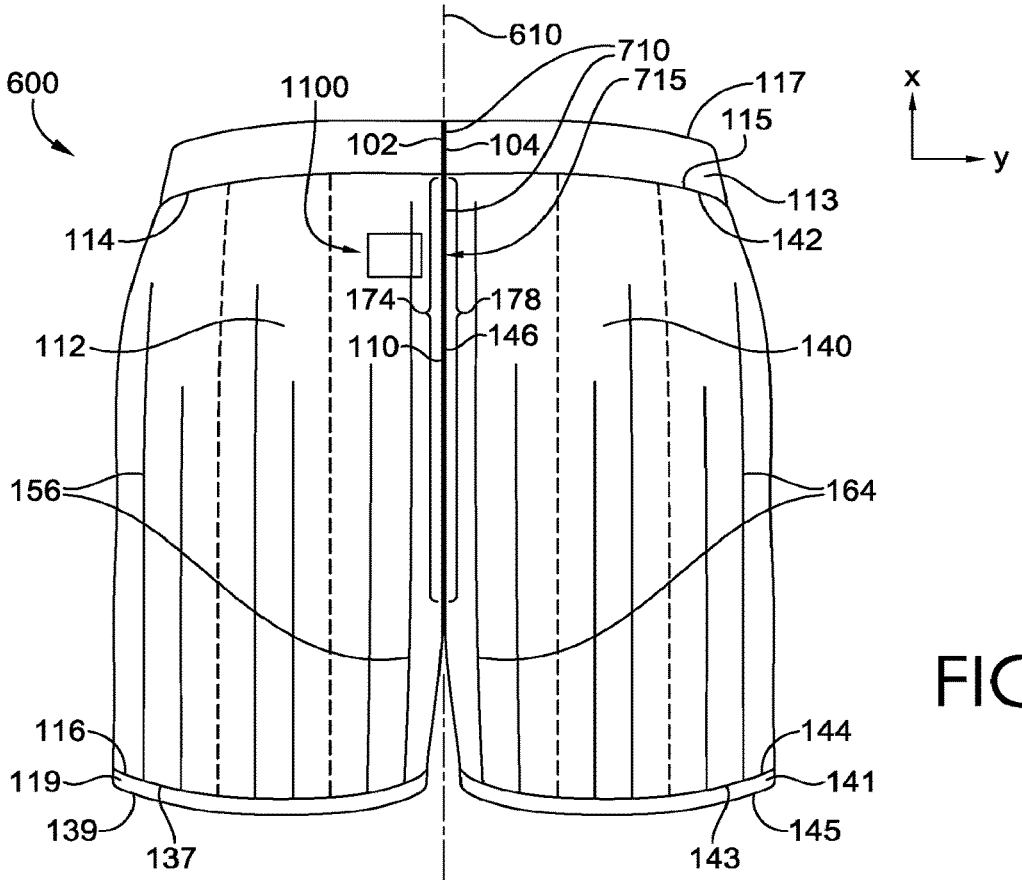
FIG. 7 illustrates a back view of the knit lower-body garment of FIG. 6 in accordance with aspects herein.

With respect to FIG. 7, the lower-body garment 600 includes the first back torso portion 112 terminating at the first back seam edge 110 and the second back torso portion 140 terminating at the second back seam edge 146. The waistband 113 extends from the first back torso portion 112 and the second back torso portion 140. The waistband 113 terminates at the first waistband seam edge 102 and the second waistband seam edge 104. The first leg band 119 extends from the first back torso portion 112, and the second leg band 141 extends from the second back torso portion 140. In example aspects, and as shown in FIG. 7, the first waistband seam edge 102 is affixed by, for instance, stitching, bonding, and the like to the second waistband seam edge 104, and the upper part 174 of the first back seam edge 110 is affixed by, for instance, stitching, bonding, and the like to the upper part 178 of the second back seam edge 146 to form a first part 715 of a seam 710 that extends vertically generally along the hypothetical midline 610.

Figure 9:
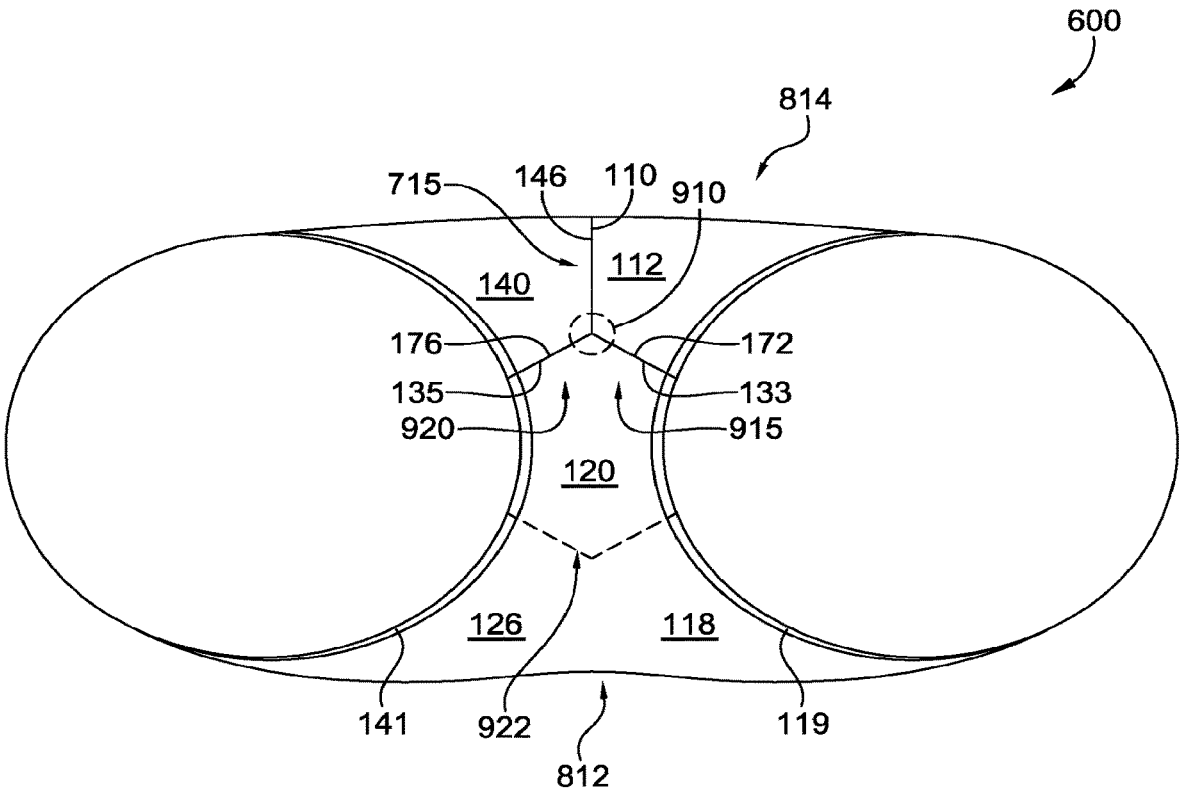
FIG. 9 illustrates a bottom view of the knit lower-body garment of FIG. 6 in accordance with aspects herein.

As shown in FIG. 9, the first part 715 of the seam 710 extends to a junction point 910 located on the back half 814 of the lower-body garment 600. The junction point 910 is formed by the intersection of the first back torso portion 112, the second back torso portion 140, and the crotch gusset 120. A second part 915 of the seam 710 extends from the junction point 910 to the first leg opening edge formed by the lower leg band edge 139 of the first leg band 119. The second part 915 of the seam 710 is formed by affixing the first gusset back edge 133 of the crotch gusset 120 to the lower part 172 of the first back seam edge 110. As such, in some aspects, the first back seam edge 110 (both the first part 174 and the second part 172), —comprises a full length knit course— extending from the waistband 113 to the junction point 910, and from the junction point 910 to the first leg band 119. A third part 920 of the seam 710 extends from the junction point 910 to the second leg opening edge formed by the lower leg band edge 145 of the second leg band 141. The third part 920 of the seam 710 is formed by affixing the second gusset back edge 135 of the crotch gusset 120 to the lower part 176 of the second back seam edge 146. As shown in FIG. 9, the seam 710 forms an inverted Y-shape comprising the first part 715, the second part 915, and the third part 920, where the first part 715, the second part 915, and the third part 920 continuously extend from each other without gaps. In example aspects, the seam 710 is the only seam present on the lower-body garment 600 which improves structural integrity (i.e., less seams to tear or rip) and reduces incidences of chafing. Stated differently, except for the seam 710, remaining portions of the lower-body garment 600 are seamless. Positioning the seam 710 on the back half 814 of the lower-body garment 600 eliminates distractions and provides a clean aesthetic to the lower-body garment 600.

Reference numeral 922 indicates the front of the crotch gusset 120. As described earlier, the front of the crotch gusset 120 is integrally knit with the first front torso portion 118 and the second front torso portion 126 such that there are no seams formed between the front of the crotch gusset 120, the first front torso portion 118, and the second front torso portion 126.

As described for the knit blank 100, the lower-body garment 600 includes partial-length knit courses at strategic locations to provide 3-D shaping to the lower-body garment 600. For example, as shown in the right-side view of FIG. 8, the right side of the lower-body garment 600 is formed from the second front torso portion 126 that forms the front half 812 of the lower-body garment 600 and the second back torso portion 140 that forms the back half 814 of the lower-body garment 600. The front half 812 is demarcated from the back half 814 by the hypothetical mid-axillary line 810.

Figure 8:
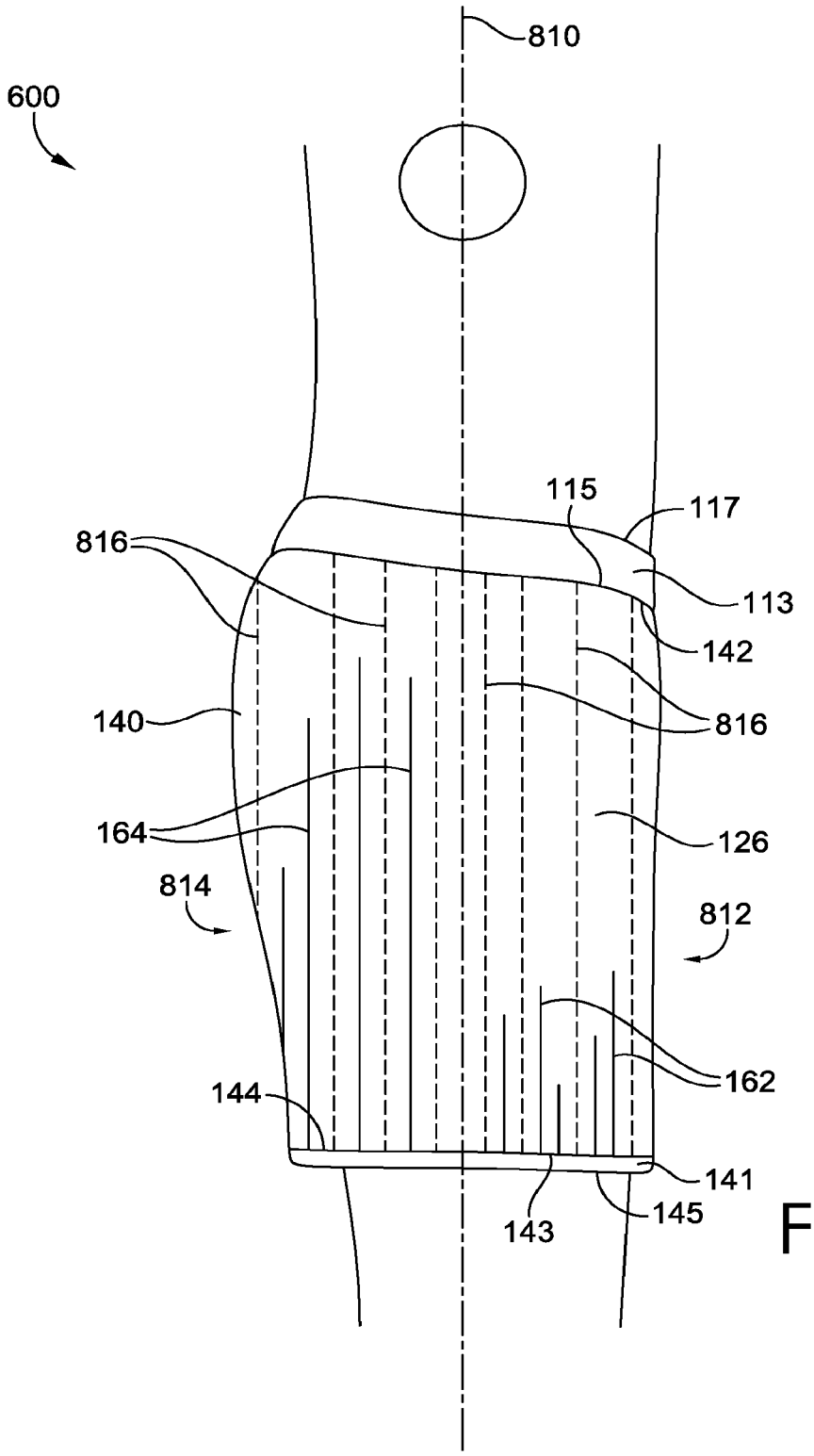
FIG. 8 illustrates a right-side view of the knit lower-body garment of FIG. 6 in accordance with aspects herein.

Both the front half 812 and the back half 814 include a plurality of knit courses 816 that continuously extend between the upper edge 142 and the lower edge 144 of the second front torso portion 126 and the second back torso portion 140. The second front torso portion 126 further includes the partial-length knit courses 162 that partially extend between the upper edge 142 and the lower edge 144 of the second front torso portion 126, where the partial-length knit courses 162 are intermittently positioned among the plurality of knit courses 816. The second back torso portion 140 includes the partial-length knit courses 164 that partially extend between the upper edge 142 and the lower edge 144 of the second back torso portion 140, where the partial-length knit courses 164 are intermittently positioned among the plurality of knit courses 816. As shown, the partial-length knit courses 164 extend a greater distance from the lower edge 144 in a direction toward the upper edge 142 as compared to the partial-length knit courses 162. As such, a number of knit stitches forming a partial-length knit course 164 differs from a number of knit stitches forming a partial-length knit course 162. In example aspects, a first number of knit stitches forming the partial-length knit courses 162 on the front half 812 of the lower-body garment 600 is less than a second number of knit stitches used to form the partial-length knit courses 164 on the back half 814 of the lower-body garment 600. The description of the right-side view of FIG. 8 is equally applicable to a left side of the lower-body garment 600. Utilizing a greater number of knit stitches to form partial-length knit courses on the back half 814 of the lower-body garment 600 as compared to the front half 812 of the lower-body garment 600 provides a greater amount of 3-D shaping to the back half 814 to accommodate the increased volume of a wearer's gluteal region.

Figure 10:
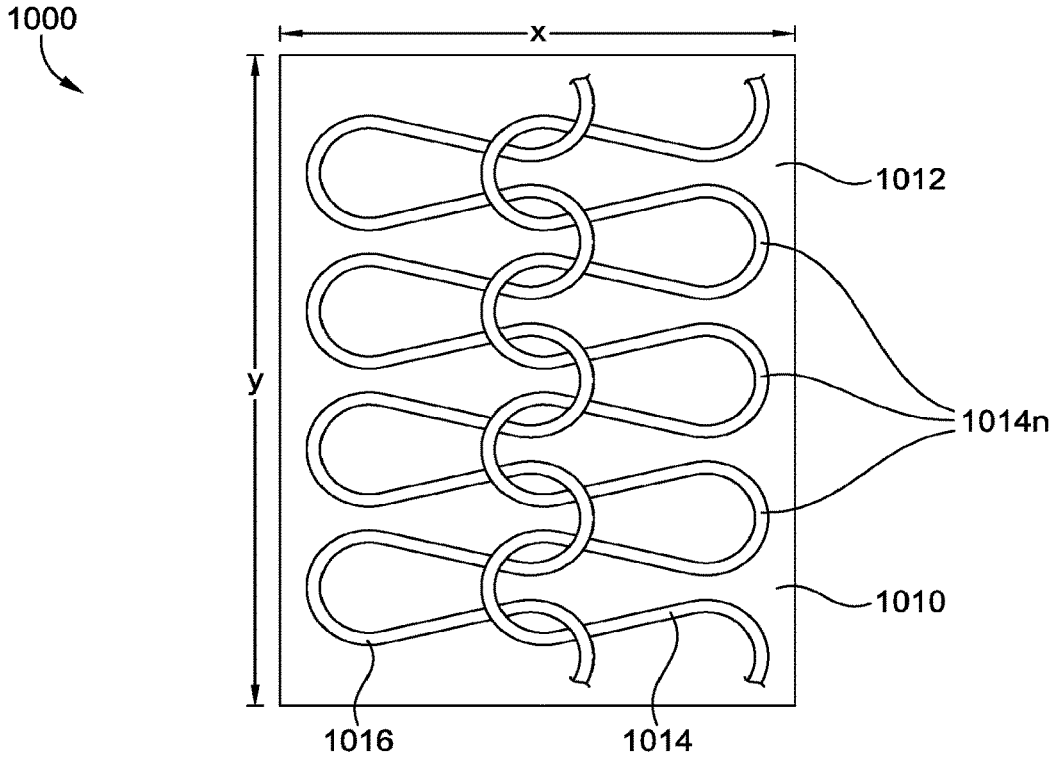
FIG. 10 illustrates an example knit schematic taken at the area indicated in FIG. 6 in accordance with aspects herein.
Figure 11:
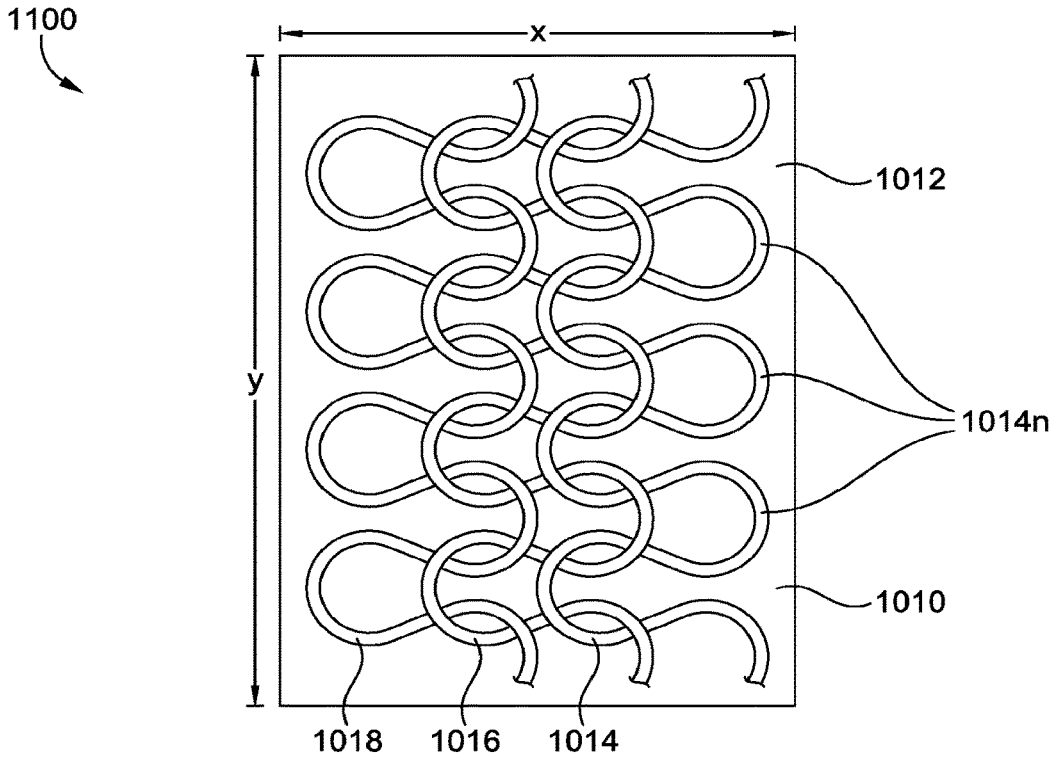
FIG. 11 illustrates an example knit schematic taken at the area indicated in FIG. 7 in accordance with aspects herein.

To describe this differently and with respect to FIGS. 10 and 11, FIG. 10 depicts a first area 1000 on the front torso portion 612 at the area indicated as 1000 on FIG. 6, and FIG. 11 depicts a second area 1100 on the first back torso portion 112 at the area indicated as 1100 on FIG. 7. In example aspects, the second area 1100 has generally the same surface area as the first area 1000. Each of the first area 1000 and the second area 1100 are adjacent to the hypothetical midline 610 (e.g., within about 5 to about 50 knit courses from the hypothetical midline 610) and extend between a first wale 1010 and a second wale 1012; the first wale 1010 is spaced apart from the second wale 1012 by an intervening number of wales 1014*n*. In example aspects, each of the first area 1000 and the second area 1100 are within from about five wales to about 100 wales from the upper edge 114/142. As illustrated in FIG. 10, the first area 1000 includes course 1014 and course 1016, where each of the courses 1014 and 1016 includes four knit stitches for a total of eight knit stitches in the first area 1000. As illustrated in FIG. 11, the second area 1100 includes the partial-length knit course 156. Thus, the second area 1100 includes the course 1114, the course 1116, and the course 1118, where one of the courses 1114, 1116, or 1118 may be the partial-length knit course 156. Each of the courses 1114, 1116, and 1118 includes four knit stitches for a total of 12 knit stitches in the second area 1110. The extra knit stitches in the second area 1110 creates an extra volume of material to produce 3-D shaping of the lower-body garment 600.

Figure 12:
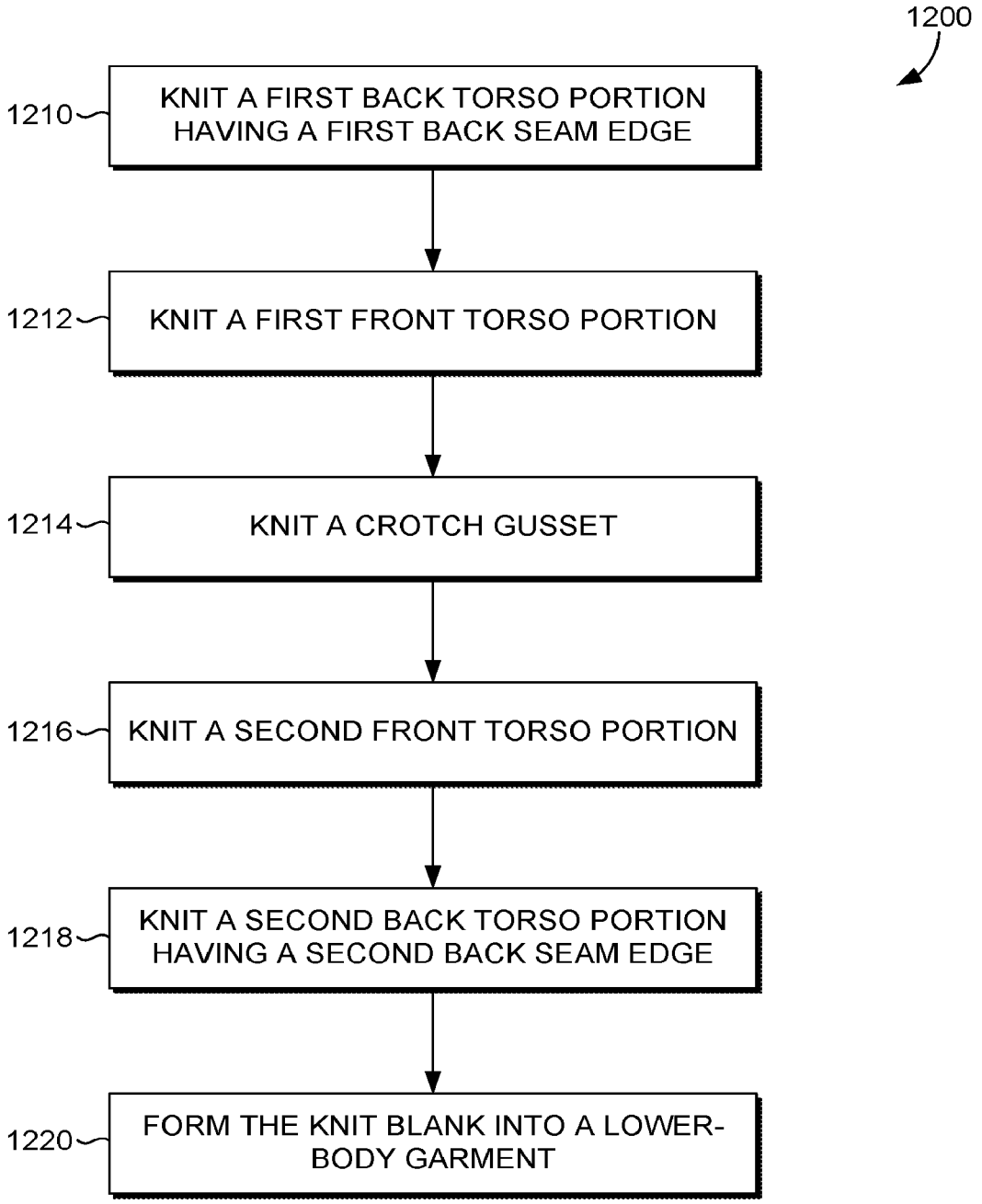
FIG. 12 illustrates a flow diagram of an example method of manufacturing a one-piece knit blank for a lower-body garment using a flat knitting process and forming the knit blank into the lower-body garment in accordance with aspects herein.
Figure 13:
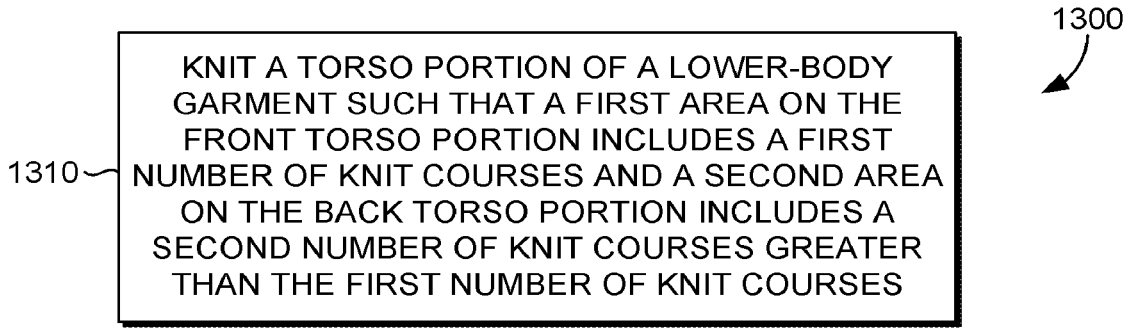
FIG. 13 illustrates a flow diagram of an example method of manufacturing a lower-body garment having three-dimensional shaping in accordance with aspects herein.
Figure 14:
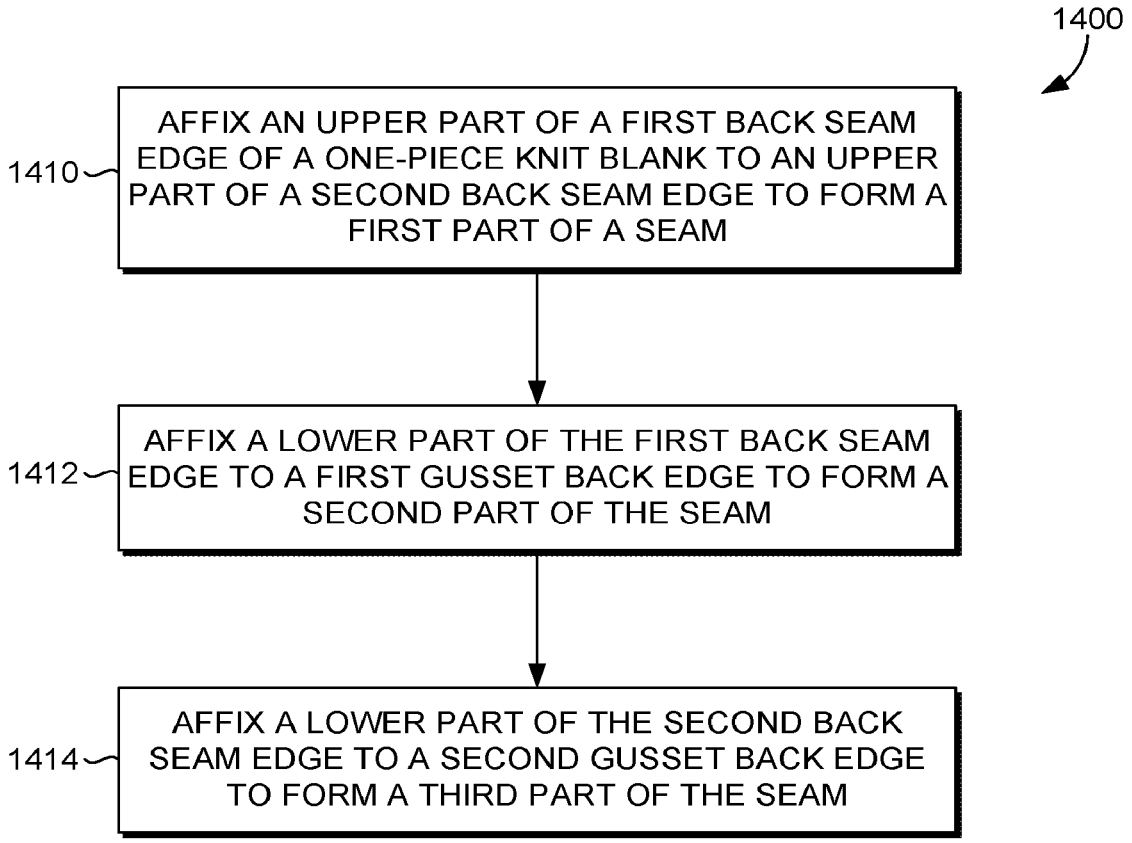
FIG. 14 illustrates a flow diagram of an example method of forming a lower-body garment from a one-piece knit blank in accordance with aspects herein.

FIGS. 12-14 depict flow diagrams of example methods as discussed herein. FIG. 12 depicts a flow diagram, referenced generally by the numeral 1200, of an example method of manufacturing a knit blank, such as the knit blank 100, for a lower-body garment, such as the lower-body garment 600. At a step 1210, and beginning at a first back seam edge, such as the first back seam edge 110, a first back torso portion, such as the first back torso portion 112, is knit. At a step 1212, subsequent to knitting the first back torso portion, a first front torso portion, such as the first front torso portion 118 is integrally knit with the first back torso portion. At a step 1214, subsequent to knitting the first front torso portion, a crotch gusset, such as the crotch gusset 120 is knit. In example aspects, a first portion of the crotch gusset, such as the first portion 121 is integrally knit with a second part of the first front torso portion, such as the second part 123 of the first front torso portion 118. At a step 1216, subsequent to knitting the crotch gusset, a second front torso portion, such as the second front torso portion 126, is integrally knit with both a second portion of the crotch gusset, such as the second portion 129 of the crotch gusset 120, and with a first part of the first front torso portion, such as the first part 125 of the first front torso portion 118. At a step 1218, subsequent to knitting the second front torso portion, a second back torso portion, such as the second back torso portion 140 is integrally knit with the second front torso portion. The second back torso portion terminates at a second back seam edge, such as the second back seam edge 146.

The method of manufacture 1200 may also optionally include knitting a waistband, such as the waistband 113, where the waistband is integrally knit with a first edge of the first back torso portion, the first front torso portion, the second front torso portion, and the second back torso portion. The method of manufacture 1200 may also optionally include knitting a first leg band, such as the first leg band 119, where a first edge of the first leg band is integrally knit with a second edge of the first back torso portion and the first front torso portion and knitting a second leg band, such as the second leg band 141, where a first edge of the second leg band is integrally knit with a second edge of the second front torso portion and the second back torso portion. The method of manufacture 1200 may additionally include a step of forming the knit blank into a lower-body garment by at least affixing together a first portion of the first back seam edge with a first portion of the second back seam edge as indicated at a step 1220. The step 1220, in example aspects, may occur at the same facility used to form the knit blank. Alternatively, the step 1220 may occur at a different facility than the one used to form the knit blank.

FIG. 13 depicts a flow diagram of an example method of manufacturing 1300 a lower-body garment having 3-D shaping. At a step 1310, a torso portion of the lower-body garment, such as the lower-body garment 600 is knit. The torso portion includes a front torso portion, such as the front torso portion 612, and a back torso portion such as the first back torso portion 112 and the second back torso portion 140. The torso portion has an upper edge, such as the upper edges 114 and 142, and the knit courses of the torso portion extend in a direction generally perpendicular to the upper edge of the torso portion. In example aspects, the front torso portion includes a first area, such as the first area 1000 adjacent to a midline of the lower-body garment that includes a first number of knit courses, such as knit course 1014 and knit course 1016. The knit courses extend continuously between a first wale, such as the first wale 1010 and a second wale, such as the second wale 1012. The first wale is spaced apart from the second wale by an intervening number of wales, such as wales 1014*n*.

The back torso portion includes a second area, such as the second area 1100 adjacent to the midline of the lower-body garment. In example aspects, the second area has generally the same surface area as the first area. The second area includes a second number of knit courses such as the course 1114, the course 1116, and the course 1118 that extend continuously between the first wale and the second wale. The second number of knit courses is greater than the first number of knit courses to produce an increased volume of material in the second area.

FIG. 14 illustrates a flow diagram of an example method 1400 of forming a lower-body garment from a one-piece knit blank produced by the manufacturing process 1200. The one-piece knit blank includes the first back torso portion having a first back seam edge, a second back torso portion having the second back seam edge, a front torso portion formed from the first front torso portion and the second front torso portion, and a crotch gusset. The crotch gusset includes a first gusset back edge such as the first gusset back edge 133 and a second gusset back edge such as the second gusset back edge 135.

At a step 1410, an upper part of the first back seam edge, such as the upper part 174 is affixed to an upper part of the second back seam edge, such as the upper part 178 to form a first part of a seam, such as the first part 715 of the seam 710. At a step 1412, a lower part of the first back seam edge, such as the lower part 172 is affixed to the first gusset back edge to form a second part of the seam, such as the second part 915 of the seam 710. At a step 1414, a lower part of the second back seam edge, such as the lower part 176 is affixed to the second gusset back edge to form a third part of the seam, such as the third part 920 of the seam 710. In example aspects, the first part, the second part, and the third part of the seam continuously extend from each other and form an inverted Y-shape. In example aspects, remaining portions of the lower-body garment are seamless.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A lower-body garment comprising: a one-piece knit textile forming a front torso portion, a first back torso portion with a first back seam edge, a second back torso portion with a second back seam edge, and a crotch gusset, wherein the crotch gusset includes a first gusset back edge and a second gusset back edge; and a seam that affixes together: an upper part of the first back seam edge and an upper part of the second back seam edge, a lower part of the first back seam edge and the first gusset back edge, and a lower part of the second back seam edge and the second gusset back edge.

Clause 2. The lower-body garment according to clause 1, wherein the seam is continuous and forms an inverted Y-shape.

Clause 3. The lower-body garment according to any of clauses 1 through 2, wherein the one-piece knit textile forms a first leg opening edge and a second leg opening edge.

Clause 4. The lower-body garment according to clause 3, wherein the one-piece knit textile further forms a waistband, a first leg band at the first leg opening edge, and a second leg band at the second leg opening edge.

Clause 5. The lower-body garment according to clause 4, wherein the seam further affixes together a first waistband seam edge to a second waistband seam edge to form the waistband.

Clause 6. The lower-body garment according to any of clauses 4 through 5, wherein the one-piece knit textile includes a plurality of knit courses that extend from the waistband to each of the first leg band and the second leg band.

Clause 7. The lower-body garment according to any of clauses 1 through 6, wherein remaining portions of the lower-body garment are seamless.

Clause 8. A lower-body garment formed from a one-piece knit textile, the lower-body garment comprising: a front torso portion and a back torso portion that together form a continuous waist opening edge, a first leg opening edge, a second leg opening edge, and a crotch gusset; and a seam having a first part that extends from the waist opening edge of the back torso portion to a junction point, a second part that extends from the junction point to the first leg opening edge, and a third part that extends from the junction point to the second leg opening edge.

Clause 9. The lower-body garment formed from the one-piece knit textile according to clause 8, wherein the seam is a stitched seam.

Clause 10. The lower-body garment formed from the one-piece knit textile according to any of clauses 8 through 9, wherein the seam is a bonded seam.

Clause 11. The lower-body garment formed from the one-piece knit textile according to any of clauses 8 through 10, wherein the seam forms an inverted Y-shape.

Clause 12. The lower-body garment formed from the one-piece knit textile according to any of clauses 8 through 11, wherein the one-piece knit textile comprises a plurality knit courses that extend from the waist opening edge to each of the first leg opening edge and the second leg opening edge.

Clause 13. The lower-body garment formed from the one-piece knit textile according to any of clauses 8 through 12, wherein remaining portions of the lower-body garment are seamless.

Clause 14. The lower-body garment formed from the one-piece knit textile according to any of clauses 8 through 13, wherein the junction point is located at an intersection of the back torso portion and the crotch gusset.

Clause 15. A method of forming a lower-body garment from a one-piece knit blank comprising a first back torso portion having a first back seam edge, a second back torso portion having a second back seam edge, a front torso portion, and a crotch gusset having a first gusset back edge and a second gusset back edge, the method comprising: affixing together at a seam: an upper part of the first back seam edge and an upper part of the second back seam edge to form a first part of the seam, a lower part of the first back seam edge and the first gusset back edge to form a second part of the seam, and a lower part of the second back seam edge and the second gusset back edge to form a third part of the seam.

Clause 16. The method of forming the lower-body garment from the one-piece knit blank according to clause 15, wherein the seam is continuous and forms an inverted Y-shape.

Clause 17. The method of forming the lower-body garment from the one-piece knit blank according to any of clauses 15 through 16, wherein remaining portions of the lower-body garment are seamless.

Clause 18. The method of forming the lower-body garment from the one-piece knit blank according to any of clauses 15 through 17, wherein the seam is one or more of a stitched seam and a bonded seam.

Clause 19. The method of forming the lower-body garment from the one-piece knit blank according to any of clauses 15 through 18, wherein after the affixing step, the lower-body garment includes a continuous waist opening edge, a continuous first leg opening edge, and a continuous second leg opening edge.

Clause 20. The method of forming the lower-body garment from the one-piece knit blank according to clause 19, wherein the first part of the seam extends to the waist opening edge, the second part of the seam extends to the first leg opening edge, and wherein the third part of the seam extends to the second leg opening edge.

Clause 21. A lower-body garment comprising: a torso portion having an upper edge and a lower edge, the torso portion divisible into a front half and a back half; and a one-piece knit textile forming the torso portion, the one-piece knit textile including: a plurality of knit courses continuously extending from the upper edge to the lower edge of torso portion, and a plurality of partial-length knit courses partially extending between the upper edge and the lower edge of the torso portion, wherein the plurality of partial-length knit courses are intermittently positioned among the plurality of knit courses, and wherein a number of knit stitches forming the plurality of partial-length knit courses differ between the front half and the back half of the torso portion.

Clause 22. The lower-body garment according to clause 21, wherein the plurality of partial-length knit courses includes a first number of knit stitches forming partial-length knit courses on the front half of the torso portion and a second number of knit stitches forming partial-length knit courses on the back half of the torso portion, the first number of knit stitches less than the second number of knit stitches.

Clause 23. The lower-body garment according to any of clauses 21 through 22, wherein the one-piece knit textile further forms a waistband, a first leg band defining a first leg opening edge, and a second leg band defining a second leg opening edge.

Clause 24. The lower-body garment according to clause 23, wherein the waistband includes a plurality of waistband knit courses that extend between an upper waistband edge and a lower waistband edge, the plurality of waistband knit courses comprising a fewer number of knit courses than the plurality of knit courses and the plurality of partial-length knit courses that form the torso portion of the lower-body garment.

Clause 25. The lower-body garment according to any of clauses 23 through 24, wherein the first leg band and the second leg band together include a plurality of leg band knit courses that extend between an upper leg band edge and a lower leg band edge of each of the first leg band and the second leg band, the plurality of leg band knit courses comprising a fewer number of knit courses than the plurality of knit courses and the plurality of partial-length knit courses that form the torso portion of the lower-body garment.

Clause 26. A lower-body garment comprising a torso portion having an upper edge, the torso portion comprising a back torso portion and a front torso portion, the lower-body garment comprising: a one-piece knit textile forming the torso portion and comprising knit courses that extend in a direction generally perpendicular to the upper edge of the torso portion, wherein: a first area of the front torso portion adjacent to the midline of the lower-body garment includes a first number of knit stitches, the first area extending between a first wale and a second wale, wherein the first wale is spaced apart from the second wale by an intervening number of wales, and a second area of the back torso portion adjacent to the midline of the lower-body garment includes a second number of knit stitches greater than the first number of knit stitches, the second area extending between the first wale and the second wale, wherein a surface area of the first area and a surface area of the second area are equal.

Clause 27. The lower-body garment comprising the torso portion according to clause 26, wherein each of the first area and the second area are within from about 5 wales to about 100 wales from the upper edge of the torso portion.

Clause 28. The lower-body garment comprising the torso portion according to any of clauses 26 through 27, wherein the torso portion comprises a single-knit construction.

Clause 29. The lower-body garment comprising the torso portion according to any of clauses 26 through 28, wherein the one-piece knit textile further forms a waistband extending from the upper edge of the torso portion.

Clause 30. The lower-body garment comprising the torso portion according to clause 29, wherein the waistband comprises a double-knit construction.

Clause 31. The lower-body garment comprising the torso portion according to any of clauses 26 through 30, wherein the one-piece knit textile further forms a crotch gusset.

Clause 32. The lower-body garment comprising the torso portion according to clause 31, wherein the crotch gusset comprises a double-knit construction.

Clause 33. A lower-body garment comprising a torso portion having an upper edge, the torso portion comprising a back torso portion and a front torso portion, the lower-body garment comprising: a one-piece knit textile forming the torso portion and comprising knit courses that extend in a direction generally perpendicular to the upper edge of the torso portion, wherein: a first area of the front torso portion adjacent to a midline of the lower-body garment includes a first number of knit courses that extend continuously between a first wale and a second wale, wherein the first wale is spaced apart from the second wale by an intervening number of wales, and a second area of the back torso portion adjacent to the midline of the lower-body garment includes a second number of knit courses that extend continuously between the first wale and the second wale, the second number of knit courses greater than the first number of knit courses, wherein a surface area of the first area and a surface area of the second area are equal.

Clause 34. The lower-body garment comprising the torso portion according to clause 33, wherein each of the first area and the second area are within from about 5 wales to about 100 wales from the upper edge of the torso portion.

Clause 35. The lower-body garment comprising the torso portion according to any of clauses 33 through 34, wherein each of the first number of knit courses and the second number of knit courses consist of knit stitches.

Clause 36. The lower-body garment comprising the torso portion according to any of clauses 33 through 35, wherein the lower-body garment comprises a short.

Clause 37. The lower-body garment comprising the torso portion according to any of clauses 33 through 36, wherein the torso portion comprises a single-knit construction.

Clause 38. The lower-body garment comprising the torso portion according to any of clauses 33 through 37, wherein the one-piece knit textile further forms a waistband extending from the upper edge of the torso portion, the waistband comprising a double-knit construction.

Clause 39. A method of manufacturing a lower-body garment, the method comprising: knitting a torso portion having an upper edge, the torso portion comprising a back torso portion and a front torso portion, wherein knit courses of the torso portion extend in a direction generally perpendicular to the upper edge of the torso portion, wherein: a first area of the front torso portion adjacent to a midline of the lower-body garment includes a first number of knit courses that extend continuously between a first wale and a second wale, wherein the first wale is spaced apart from the second wale by an intervening number of wales, and a second area of the back torso portion adjacent to the midline of the lower-body garment includes a second number of knit courses that extend continuously between the first wale and the second wale, the second number of knit courses greater than the first number of knit courses, wherein the first area and the second area include a same number of knit courses.

Clause 40. A method of manufacturing a lower-body garment using a flat knitting process, the method comprising: beginning at a first back seam edge, knitting a first back torso portion of the lower-body garment; subsequently knitting a first front torso portion of the lower-body garment, the first front torso portion integrally knit with the first back torso portion; subsequently knitting a crotch gusset, a first portion of the crotch gusset integrally knit with the first front torso portion; subsequently knitting a second front torso portion of the lower-body garment, the second front torso portion integrally knit with a second portion of the crotch gusset; subsequently knitting a second back torso portion of the lower-body garment to form a knit blank for the lower-body garment, the second back torso portion integrally knit with the second front torso portion, the second back torso portion terminating at a second back seam edge; and forming the knit blank into the lower-body garment by at least affixing together a first portion of the first back seam edge with a first portion of the second back seam edge.

Clause 41. The method of manufacturing the lower-body garment using the flat knitting process according to clause 40, wherein the first front torso portion is integrally knit with the second front torso portion.

Clause 42. The method of manufacturing the lower-body garment using the flat knitting process according to any of clauses 40 through 41, further comprising knitting a waistband, wherein a first edge of the waistband is integrally knit with a first edge of each of the first back torso portion, the first front torso portion, the second front torso portion, and the second back torso portion, and wherein an opposite second edge of the waistband is a finished edge free from surrounding textile.

Clause 43. The method of manufacturing the lower-body garment using the flat knitting process according to any of clauses 40 through 42, further comprising: knitting a first leg band, wherein a first edge of the first leg band is integrally knit with a second edge of each of the first back torso portion and the first front torso portion, and knitting a second leg band, wherein a first edge of the second leg band is integrally knit with a second edge of each of the second front torso portion and the second back torso portion.

Clause 44. The method of manufacturing the lower-body garment using the flat knitting process according to clause 43, wherein an opposite second edge of each of the first leg band and the second leg band is a finished edge free from surrounding textile.

Clause 45. The method of manufacturing the lower-body garment using the flat knitting process according to any of clauses 42 through 44, wherein a distance between the second edge of the waistband and the second edge of the first leg band at the first front torso portion is less than a distance between the second edge of the waistband and the second edge of the first leg band at the first back torso portion, and wherein a distance between the second edge of the waistband and the second edge of the second leg band at the second front torso portion is less than a distance between the second edge of the waistband and the second edge of the second leg band at the second back torso portion.

Clause 46. The method of manufacturing the lower-body garment using the flat knitting process according to any of clauses 40 through 45, wherein prior to forming the knit blank into the lower-body garment, the crotch gusset includes a first gusset back edge that is finished and free from surrounding textile and a second gusset back edge that is finished and free from surrounding textile.

Clause 47. The method of manufacturing the lower-body garment using the flat knitting process according to clause 46, wherein forming the knit blank into the lower-body garment further comprises affixing a second portion of the first back seam edge to the first gusset back edge and affixing a second portion of the second back seam edge to the second gusset back edge.

Clause 48. A method of manufacturing a knit blank for a lower-body garment using a flat knitting process, the method comprising: beginning at a first back seam edge, knitting a first back torso portion of the lower-body garment; subsequently knitting a first front torso portion of the lower-body garment, the first front torso portion integrally knit with the first back torso portion; subsequently knitting a crotch gusset, a first portion of the crotch gusset integrally knit with the first front torso portion; subsequently knitting a second front torso portion of the lower-body garment, the second front torso portion integrally knit with a second portion of the crotch gusset; and subsequently knitting a second back torso portion of the lower-body garment to form the knit blank for the lower-body garment, the second back torso portion integrally knit with the second front torso portion, the second back torso portion terminating at a second back seam edge.

Clause 49. The method of manufacturing the knit blank for the lower-body garment using the flat knitting process according to clause 48, wherein the first front torso portion is integrally knit with the second front torso portion.

Clause 50. The method of manufacturing the knit blank for the lower-body garment using the flat knitting process according to any of clauses 48 through 49, further comprising knitting a waistband, wherein a first edge of the waistband is integrally knit with a first edge of each of the first back torso portion, the first front torso portion, the second front torso portion, and the second back torso portion, and wherein an opposite second edge of the waistband is a finished edge free from surrounding textile.

Clause 51. The method of manufacturing the knit blank for the lower-body garment using the flat knitting process according to any of clauses 48 through 50, further comprising: knitting a first leg band, wherein a first edge of the first leg band is integrally knit with a second edge of each of the first back torso portion and the first front torso portion; and knitting a second leg band, wherein a first edge of the second leg band is integrally knit with a second edge of each of the second front torso portion and the second back torso portion.

Clause 52. The method of manufacturing the knit blank for the lower-body garment using the flat knitting process according to clause 51, wherein an opposite second edge of each of the first leg band and the second leg band is a finished edge free from surrounding textile.

Clause 53. The method of manufacturing the knit blank for the lower-body garment using the flat knitting process according to any of clauses 50 through 52, wherein a distance between the second edge of the waistband and the second edge of the first leg band at the first front torso portion is less than a distance between the second edge of the waistband and the second edge of the first leg band at the first back torso portion, and wherein a distance between the second edge of the waistband and the second edge of the second leg band at the second front torso portion is less than a distance between the second edge of the waistband and the second edge of the second leg band at the second back torso portion.

Clause 54. A knit blank for a lower-body garment, the knit blank extending in an x, y plane and comprising: a first back torso portion extending from a first back seam edge; a first front torso portion integrally knit with the first back torso portion; a second front torso portion; a crotch gusset positioned between the first front torso portion and the second front torso portion, a first portion of the crotch gusset integrally knit with the first front torso portion and a second portion of the crotch gusset integrally knit with the second front torso portion; and a second back torso portion integrally knit with the second front torso portion, the second back torso portion terminating at a second back seam edge.

Clause 55. The knit blank for the lower-body garment according to clause 54, wherein the first front torso portion is further integrally knit with the second front torso portion.

Clause 56. The knit blank for the lower-body garment according to any of clauses 54 through 55, further comprising a waistband, wherein a first edge of the waistband is integrally knit with a first edge of each of the first back torso portion, the first front torso portion, the second front torso portion, and the second back torso portion, and wherein an opposite second edge of the waistband is a finished edge free from surrounding textile.

Clause 57. The knit blank for the lower-body garment according to any of clauses 54 through 56, further comprising: a first leg band, wherein a first edge of the first leg band is integrally knit with a second edge of each of the first back torso portion and the first front torso portion; and a second leg band, wherein a first edge of the second leg band is integrally knit with a second edge of each of the second front torso portion and the second back torso portion.

Clause 58. The knit blank for the lower-body garment according to clause 57, wherein a first end of the first leg band terminates at the first back seam edge, and wherein a first end of the second leg band terminates at the second back seam edge.

Clause 59. The knit blank for the lower-body garment according to any of clauses 57 through 58, wherein a second end of the first leg band is integrally knit with the first portion of the crotch gusset, and wherein a second end of the second leg band is integrally knit with the second portion of the crotch gusset.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A lower-body garment divisible between a front half and a back half comprising:

a one-piece flat knit textile having an upper edge and a lower edge configured to form at least a front torso portion and a back torso portion, the one-piece flat knit textile comprising:

a plurality of full-length knit courses continuously extending from the upper edge to the lower edge, and a plurality of partial-length knit courses partially extending between the upper edge and the lower edge, wherein the plurality of partial-length knit courses are intermittently positioned among the plurality of full-length knit courses with each of the partial-length knit courses positioned between two knit courses of the plurality of full-length knit courses that continuously extend from the upper edge to the lower edge, and wherein a number of knit stitches forming the plurality of partial-length knit courses differ between the front half and the back half;

wherein each of the plurality of partial-length knit courses extends from the lower edge; and wherein the one-piece flat knit textile further forms a waistband, a first leg band defining a first leg opening edge, and a second leg band defining a second leg opening edge.

2. The lower-body garment of claim 1, wherein the plurality of partial-length knit courses includes a first number of knit stitches forming partial-length knit courses on the front torso portion and a second number of knit stitches forming partial-length knit courses on the back torso portion, the first number of knit stitches less than the second number of knit stitches.

3. The lower-body garment of claim 1, wherein the waistband includes a plurality of waistband knit courses that extend between an upper waistband edge and a lower waistband edge, the plurality of waistband knit courses comprising a fewer number of knit courses than the plurality of full-length knit courses and the plurality of partial-length knit courses that form the front torso portion and the back torso portion of the lower-body garment.

4. The lower-body garment of claim 1, wherein the first leg band and the second leg band together include a plurality of leg band knit courses that extend between an upper leg band edge and a lower leg band edge of each of the first leg band and the second leg band, the plurality of leg band knit courses comprising a fewer number of knit courses than the plurality of full-length knit courses and the plurality of partial-length knit courses that form the front torso portion and the back torso portion of the lower-body garment.

5. A lower-body garment divisible between a front half and a back half comprising:

a one-piece flat knit textile having an upper edge and a lower edge configured to form at least a front torso portion and a back torso portion, the one-piece flat knit textile comprising:

a plurality of full-length knit courses continuously extending from the upper edge to the lower edge, and a plurality of partial-length knit courses partially extending between the upper edge and the lower edge, wherein:

the plurality of partial-length knit courses are intermittently positioned among the plurality of full-length knit courses with each of the partial-length knit courses positioned between two knit courses of the plurality of full-length knit courses that continuously extend from the upper edge to the lower edge, and wherein a number of knit stitches forming the plurality of partial-length knit courses differ between the front half and the back half;

each of the plurality of partial-length knit courses extends from the lower edge; and the one-piece flat knit textile is a weft knit textile further comprising a crotch gusset, wherein the crotch gusset comprises a double jersey knit structure and the front torso portion comprises a single jersey knit structure.

* * * * *